US011110505B2

(12) United States Patent
Kohno

(10) Patent No.: US 11,110,505 B2
(45) Date of Patent: Sep. 7, 2021

(54) CUSHION PIN PRESSURE EQUALIZING DEVICE, DIE CUSHION DEVICE WITH CUSHION PIN PRESSURE EQUALIZING FUNCTION AND CUSHION PIN PRESSURE EQUALIZING METHOD

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 248 days.

(21) Appl. No.: 16/291,363

(22) Filed: Mar. 4, 2019

(65) Prior Publication Data

US 2019/0270129 A1 Sep. 5, 2019

(30) Foreign Application Priority Data

Mar. 5, 2018 (JP) ..... JP2018-038745

(51) Int. Cl.
*B21D 24/02* (2006.01)
*B21D 24/08* (2006.01)
*B21D 24/14* (2006.01)

(52) U.S. Cl.
CPC ..... *B21D 24/02* (2013.01); *B21D 24/08* (2013.01); *B21D 24/14* (2013.01);
(Continued)

(58) Field of Classification Search
CPC ..... B21D 24/02; B21D 24/14; B30B 15/061; B30B 15/245; B30B 15/163;
(Continued)

(56) References Cited

U.S. PATENT DOCUMENTS 2,672,836 A * 3/1954 Ernst ..... B21D 24/14 72/417
5,299,444 A 4/1994 Kirii et al.
(Continued)

FOREIGN PATENT DOCUMENTS

JP H05-069050 A 3/1993
JP H06-190464 A 7/1994
(Continued)

OTHER PUBLICATIONS

Extended European Search Report issued in corresponding European Patent Application No. 19159544.6, dated Aug. 6, 2019.

*Primary Examiner* — Shelley M Self
*Assistant Examiner* — Fred C Hammers
(74) *Attorney, Agent, or Firm* — McDermott Will & Emery LLP

(57) ABSTRACT

A cushion pin pressure equalizing device that can absorb a variation in height of a plurality of cushion pins and control a die cushion load highly accurately, a die cushion device, and a cushion pin pressure equalizing method are provided. An initial pressure in ascending-side pressurizing chambers of a pressure equalizing hydraulic cylinder group for absorbing a variation in height of cushion pins is controlled so as to be an appropriate pressure. The variation in height of the plurality of cushion pins can be absorbed within a shortest stroke of a slide after the slide comes into collision with a cushion pad so as to equalize die cushion loads that are applied individually to the cushion pins and a target die cushion load can be generated within the shortest stroke of the slide, whereby a response to application of the die cushion load can be stabilized without excessive delay.

10 Claims, 14 Drawing Sheets

(52) U.S. Cl.
CPC ..... *F15B 2211/20515* (2013.01); *F15B 2211/20576* (2013.01); *F15B 2211/212* (2013.01); *F15B 2211/27* (2013.01); *F15B 2211/633* (2013.01); *F15B 2211/6309* (2013.01); *F15B 2211/6336* (2013.01); *F15B 2211/6651* (2013.01); *F15B 2211/6653* (2013.01); *F15B 2211/7107* (2013.01); *F15B 2211/76* (2013.01); *F15B 2211/88* (2013.01)

(58) Field of Classification Search
CPC ..... B30B 15/0052; F15B 15/18; F15B 2211/20561; F15B 2211/212; F15B 2211/20576
USPC ..... 72/453.13
See application file for complete search history.

(56) References Cited

U.S. PATENT DOCUMENTS 5,457,980 A 10/1995 Kirii et al.
5,735,201 A * 4/1998 Hirao ..... B21D 24/12 100/269.01
7,921,689 B2 * 4/2011 Anderson ..... B30B 1/38 72/453.01
8,127,590 B2 * 3/2012 Kohno ..... B21D 24/02 72/453.13
8,757,056 B2 * 6/2014 Kohno ..... B21D 24/14 100/50
2009/0071218 A1 3/2009 Kohno et al.
2016/0354828 A1 * 12/2016 Kohno ..... B21D 24/10
2017/0204887 A1 * 7/2017 Matsuzaki ..... E02F 3/308
2017/0284388 A1 * 10/2017 Caldwell ..... F04B 1/063
2017/0304887 A1 * 10/2017 Kohno ..... B21D 24/02
2018/0104736 A1 * 4/2018 McLaughlin ..... B21D 24/14
2019/0055964 A1 * 2/2019 Henderson ..... F03B 13/14

FOREIGN PATENT DOCUMENTS

JP H08-001247 A 1/1996
JP 2006-315074 A 11/2006

* cited by examiner

CUSHION PIN PRESSURE EQUALIZING DEVICE, DIE CUSHION DEVICE WITH CUSHION PIN PRESSURE EQUALIZING FUNCTION AND CUSHION PIN PRESSURE EQUALIZING METHOD

CROSS-REFERENCE TO RELATED APPLICATIONS

The present application claims priority under 35 U.S.C. § 119 to Japanese Patent Application No. 2018-038745, filed on Mar. 5, 2018. The above application is hereby expressly incorporated by reference, in its entirety, into the present application.

BACKGROUND OF THE INVENTION

Field of the Invention

The present invention relates to a cushion pin pressure equalizing device, a die cushion device with a function of equalizing a cushion pin pressure and a cushion pin pressure equalizing method, and more particularly to a technique to improve a drawing accuracy by absorbing a variation in height of a plurality of cushion pins of a die cushion device and applying a favorable (uniform) blank holding force (blank holding component force) to each of the cushion pins.

Description of the Related Art

Patent Literatures 1 to 3 describe conventional devices which equalize a blank holding force applied to a plurality of cushion pins of a die cushion device by absorbing a variation in height of the plurality of cushion pins.

In a press machine described in Patent Literature 1 (Japanese Patent Application Laid-Open No. H05-069050), lower ends of a plurality of cushion pins that support a blank holder are individually connected to a cushion pad of a die cushion via pressure equalizing hydraulic cylinders, and an initial hydraulic pressure supplied to the individual hydraulic cylinders can be controlled by an initial pressure controlling device.

In particular, the initial pressure controlling device controls the respective initial hydraulic pressures of the hydraulic cylinders so that the initial hydraulic pressures have a value (an equalized pressure value) which should be obtained when a press load is balanced with a hydraulic pressure applied commonly to the individual hydraulic cylinders, without all the cushion pins being pushed completely to their stroke ends. This initial hydraulic pressure control prevents a state where a short cushion pin does not come into contact with the blank holder due to the variation in length of the cushion pins when the initial hydraulic pressure is too high, or a state where a part (a long cushion pin) of the cushion pins is pushed completely to the stroke end of the corresponding hydraulic cylinder and rammed when the initial hydraulic pressure is too low.

A controlling device of a pressure equalizing cushion device for a press machine described in Patent Literature 2 (Japanese Patent Application Laid-Open No. H08-001247) controls an initial pressure of the pressure equalizing hydraulic cylinders, as the initial pressure controlling device of Patent Literature 1 does. Specifically, in the controlling device of Patent Literature 2, a piston stroke dimension (an average value of a descending amount of a piston of the hydraulic cylinder for bringing all cushion pins into contact with a blank holder) of the hydraulic cylinder at the time of pressing, matches a set dimension which is determined in advance for a press die, to thereby obtain an appropriate press quality.

In a die cushion device of a press machine described in Patent Literature 3 (Japanese Patent Application Laid-Open No. H06-190464), a flow rate control valve that can continuously change an opening amount (a flow sectional area) is provided in a piping that communicates with hydraulic pressurizing chambers of the pressure equalizing hydraulic cylinders that support respective lower ends of a plurality of cushion pins. At the time of pressing where the cushion pins, the hydraulic cylinders and a cushion pad descend integrally, a controller opens the flow rate control valve so as to cause a working fluid to flow out, whereby hydraulic pressures in the hydraulic cylinders are reduced temporarily to control a blank holder load (a die cushion load).

PATENT LITERATURES

Patent Literature 1: Japanese Patent Application Laid-Open No. H05-069050

Patent Literature 2: Japanese Patent Application Laid-Open No. H08-001247

Patent Literature 3: Japanese Patent Application Laid-Open No. H06-190464

SUMMARY OF THE INVENTION

The cushion pin pressure equalizing function represented by the devices described in Patent Literatures 1 to 3 equalizes the blank holding force applied to the plurality of cushion pins by absorbing the variation in height of the plurality of cushion pins. Conventionally, that cushion pin pressure equalizing function has an established reputation as a function of improving the drawing accuracy.

However, the conventional cushion pin pressure equalizing devices have various problems. The problems include (a) a problem that the maintenance of the pressure equalizing hydraulic cylinders (piston seals or the like) is troublesome, and (b) a problem that only the cushion pin pressure equalizing function is insufficient in fulfilling the drawing function. There are many problems other than these problems.

Hereinafter, the Problem (a) and the Problem (b) will be described in detail.

<Problem (a): Maintenance of Pressure Equalizing Hydraulic Cylinders (Piston Seals or the Like) is Troublesome>

Patent Literatures 1 to 3 describe embodiments employing a pneumatic die cushion device (a die cushion load is generated by an air cylinder). In the pneumatic die cushion device, a surge (an impact) tends to be generated easily when a die cushion load starts to be applied.

This is because a cushion pad acceleration reaction force becomes large in the pneumatic die cushion device. This corresponds to an impact force. An air cylinder thrust of the pneumatic die cushion device is applied (upwardly) to one end of a frame of a press machine before the die cushion load starts to be applied. When a press slide comes into contact with the cushion pad via die cushion pressing members such as an upper die, a material (blank), a blank holder, cushion pins, and the like at the start of application of the die cushion load, firstly, the one end of the frame that has been loaded and compressed starts to be unloaded. At the same time, the die cushion pressing members start to be pressed and compressed. Next, when the die cushion load is loaded on the due cushion pressing members, that is, at the moment the one end of the frame is completely unloaded and the die cushion pressing members are completely compressed, the cushion pad is accelerated downward drastically at a time point. Since the acceleration at this moment is large, the acceleration reaction force (the impact force) that accelerates the whole mass (associated mass) that is associated with the cushion pad becomes large. Moreover, since the viscosity (drag coefficient) of a cushion pad lift mechanism (cushion pad ascending/descending mechanism) is very small, it becomes difficult to dampen vibrations generated in association with the impact.

Consequently, in the cushion pin pressure equalizing devices described in Patent Literatures 1 to 3 that are applied to the pneumatic die cushion device, when the die cushion load starts to be applied, the die cushion load which is applied with impact (percussively) acts directly on the pressure equalizing hydraulic cylinders. Therefore, a surge pressure proportional to the die cushion load is also generated in the hydraulic cylinders. A repeated application of the surge pressure (for each cycle) affects badly piston seals of the pressure equalizing hydraulic cylinders and promotes the deterioration of the piston seals.

Further, there is also a considerable problem of heat generation (increase in temperature of a fluid) in a hydraulic device which generates an initial hydraulic pressure for each cycle in the pressure equalizing hydraulic cylinders.

As described briefly in Patent Literatures 1 and 2, when a hydraulic device of a general configuration which controls an initial hydraulic pressure by releasing part of an amount of hydraulic fluid ejected by rotation of a hydraulic pump to a tank side by opening or closing an on-off valve (closing valve) or which generates an initial hydraulic pressure with a relief valve in place of the closing valve is used (that is, an initial pressure generating device employing a valve control is used), the temperature of the fluid exceeds 40° C. steadily in most cases, and it is not unusual that the temperature of the fluid exceeds 50° C. The life of a standard piston seal of a nitrile rubber correlates with the temperature of a fluid, and using such a piston seal steadily under the high fluid temperature environment promotes the deterioration of the piston seal remarkably.

<Problem (b): Cushion Pin Pressure Equalizing Function Alone is Insufficient in Fulfilling the Drawing Function>

Patent Literature 3 describes not only the cushion pin pressure equalizing function but also a technique of controlling a blank holder load (a die cushion load).

Patent Literature 3 describes its object as reading "by enabling a blank holder load to be controlled in precision according to a press stroke, that is, the progress of a pressing operation, various advantages can be obtained; for example, the blank holder load is reduced in the midst of pressing to prevent the failure of work, or a material of a lower grade can be used by preventing the failure of work in that way. Thus, better pressing work is attainable by combining the blank holder load controlling function (Function A) and the equalization of the blank holder load (Function B)," and also discloses a device that realizes those (Function A and Function B) at low costs.

Patent Literature 3 describes that the device changes the blank holder load in the process of pressing by draining a working fluid in the pressure equalizing hydraulic cylinders (which is configured to apply the blank holder load uniformly) via a flow rate control valve (which is controlled by a flow control device). However, this is no true (this is wrong from the physical point of view).

The blank holder load cannot be changed no matter how the working fluid in the pressure equalizing hydraulic cylinders is flowed out. What determines (applies) the blank holder load (that is, the die cushion load) is a device (blank holder load applying device) which applies blank holder load, and the blank holder load is transmitted to the press slide via the die cushion pressing members such as the cushion pad, the pressure equalizing hydraulic cylinders, the cushion pins, the blank holder and the upper die in series.

The pressure equalizing hydraulic cylinders is one element arranged (in series) in "one passageway" to which the blank holder load is applied and bear the blank holder load generated by the blank holder load applying device physically (inevitably). In the event that flow rate control valve is opened (more or less) as described in Patent Literature 3 while the blank holder load is being applied, piston rods in the pressure equalizing hydraulic cylinders descend drastically by an amount corresponding to a volume of the working fluid that is discharged from the flow rate control valve momentarily the flow rate control valve opens, and the cushion pins and the blank holder descend in association with the descent of the piston rods. The blank holder load becomes nil (0) while they are descending, and after they finish the descent, the original blank holder load is restored. That is, the discharge of the working fluid results in that the generation of drawing wrinkles, which is caused due to a drawing operation being kept progressing while the blank holder load is lost momentarily, is promoted, and only a very unsuitable situation for drawing is caused.

That is, although Patent Literature 3 tries to use the pressure equalizing hydraulic cylinders (and their hydraulic driving device) also as a blank holder load controlling device, Patent Literature 3 includes the physical contradiction (functional failure).

Consequently, although the die cushion device of the press machine described in Patent Literature 3 has the blank holder load equalizing function (Function B), the blank holder load controlling function (Function A) is lost.

The invention has been made in these situations, and aims to provide a cushion pin pressure equalizing device, a die cushion device with a cushion pin pressure equalizing function and a cushion pin pressure equalizing method which can realize equalization of a blank holder load (a die cushion load) that is applied individually to a plurality of cushion pins by absorbing a variation in height of the cushion pins and control the die cushion load accurately.

In order to achieve the object, according to a first aspect of the invention, there is provided a cushion pin pressure equalizing device for a die cushion device including a plurality of cushion pins inserted through a bolster of a press machine, a cushion pad configured to support a blank holder via the plurality of cushion pins, a die cushion load generator configured to generate a die cushion load to be applied to the cushion pad, and a die cushion controller configured to control the die cushion load generator so that the die cushion load generated by the die cushion load generator becomes a set target die cushion load, the cushion pin pressure equalizing device including: a hydraulic cylinder group provided on the cushion pad in which lower ends of the cushion pins that are inserted through the bolster are brought into abutment with piston rods of the hydraulic cylinder group, and ascending-side pressurizing chambers of the hydraulic cylinder group are in communication with each other; a hydraulic device configured to supply working fluid to the ascending-side pressurizing chambers of the hydraulic cylinder group or to discharge the working fluid from the ascending-side pressurizing chambers; a pressure detector configured to detect a pressure of the ascending-side pressurizing chambers of the hydraulic cylinder group; an initial pressure setting unit configured to set an initial pressure in the ascending-side pressurizing chambers of the hydraulic cylinder group; and a controller configured to control the hydraulic device based on the initial pressure set by the initial pressure setting unit and the pressure detected by the pressure detector, so that the pressure in the ascending-side pressurizing chambers of the hydraulic cylinder group becomes the initial pressure before the die cushion device starts application of the die cushion load, wherein the initial pressure setting unit sets the initial pressure based on a total volume of the ascending-side pressurizing chambers of the hydraulic cylinder group and a pipe line, a minimum volume change amount of the ascending-side pressurizing chambers of the hydraulic cylinder group when a variation in height of the plurality of cushion pins is absorbed and a volume elastic modulus of the working fluid so that a pressure of the working fluid that increases when the total volume of the working fluid having the initial pressure is compressed by the volume change amount becomes a pressure corresponding to a lowest die cushion load of the set target die cushion load.

According to the first aspect of the invention, the initial pressure in the ascending-side pressurizing chambers of the pressure equalizing hydraulic cylinder group which absorbs the variation in height of the plurality of cushion pins is set to the proper pressure (the initial pressure resulting when the pressure of the working fluid that increases when of the total volume of the working fluid having the initial pressure is compressed by the volume change amount becomes the pressure corresponding to the lowest die cushion load of the set target die cushion load based on the total volume of the ascending-side pressurizing chambers of the hydraulic cylinder group and the pipe line, the minimum volume change amount of the ascending-side pressurizing chambers of the hydraulic cylinder group when the variation in height of the plurality of cushion pins is absorbed, and the volume elastic modulus of the working fluid).

By adopting this configuration, after the slide collides against the cushion pad, the variation in height of the plurality of cushion pins can be absorbed within a shortest stroke of the slide (within a shortest time), whereby the blank holder load (the die cushion load) applied to the individual cushion pins can be equalized. In addition, the target die cushion load can be generated within the shortest stroke of the slide (within the shortest time). Thus, when the die cushion controller controls the die cushion load generator so that the set target die cushion load is generated, the response to application of the die cushion load (the blank holder load) can be stabilized without excessive delay.

According to a second aspect of the invention, in the cushion pin pressure equalizing device, it is preferable that the controller controls the hydraulic device so that the pressure in the ascending-side pressurizing chambers of the hydraulic cylinder group becomes the initial pressure while the cushion pad is waiting in one operation cycle of the press machine, except a pressing process and a knockout process. This is because while the cushion pad is waiting, there is no change in pressure in the working fluid sealed in the ascending-side pressurizing chambers of the hydraulic cylinder group, and hence, the time period during which the cushion pad is waiting is suitable for setting the pressure in the ascending-side pressurizing chambers to the initial pressure.

According to a third aspect of the invention, there is provided a die cushion device with a cushion pin pressure equalizing function including: a plurality of cushion pins inserted through a bolster of a press machine; a cushion pad configured to support a blank holder via the plurality of cushion pins; a hydraulic cylinder configured to support the cushion pad and generate a die cushion load to be applied to the cushion pad; a first hydraulic device configured to supply working fluid to an ascending-side pressurizing chamber of the hydraulic cylinder or discharge the working fluid from the ascending-side pressurizing chamber; a first pressure detector configured to detect a pressure in the ascending-side pressurizing chamber of the hydraulic cylinder; a first controller configured to control the first hydraulic device based on the pressure detected by the first pressure detector so that the die cushion load generated by the hydraulic cylinder becomes a set target die cushion load; a hydraulic cylinder group provided on the cushion pad in which lower ends of the cushion pins that are inserted through the bolster are brought into abutment with piston rods of the hydraulic cylinder group, and the ascending-side pressurizing chambers of the hydraulic cylinder group are in communication with each other; a second hydraulic device configured to supply working fluid to the ascending-side pressurizing chambers of the hydraulic cylinder group or discharge the working fluid from the ascending-side pressurizing chambers; a second pressure detector configured to detect a pressure in the ascending-side pressurizing chambers of the hydraulic cylinder group; an initial pressure setting unit configured to set an initial pressure in the ascending-side pressurizing chambers of the hydraulic cylinder group; and a second controller configured to control the second hydraulic device based on the initial pressure set by the initial pressure setting unit and the pressure detected by the second pressure detector so that the pressure in the ascending-side pressurizing chambers of the hydraulic cylinder group becomes the initial pressure before the die cushion load starts to be applied, wherein the first hydraulic device doubles as the second hydraulic device, and wherein the initial pressure setting unit sets the initial pressure based on a total volume of the ascending-side pressurizing chambers of the hydraulic cylinder group and a pipe line, a minimum volume change amount of the ascending-side pressurizing chambers of the hydraulic cylinder group when a variation in height of the plurality of cushion pins is absorbed, and a volume elastic modulus of the working fluid so that a pressure of the working fluid that increases when the total volume of the working fluid having the initial pressure is compressed by the volume change amount becomes a pressure corresponding to a lowest die cushion load of the set target die cushion load.

According to the third aspect of the invention, by setting the initial pressure of the ascending-side pressurizing chambers of the pressure equalizing hydraulic cylinder group to the proper pressure, after the slide collides against the cushion pad, the variation in height of the plurality of cushion pins can be absorbed within a shortest stroke of the slide (within a shortest time), whereby the blank holder load (the die cushion load) applied to the individual cushion pins can be equalized. In addition, the target die cushion load can be generated within the shortest stroke of the slide (within the shortest time), whereby when the die cushion controller controls the die cushion load generator so that the set target die cushion load is generated, the response to application of the die cushion load (the blank holder load) can be stabilized without excessive delay. Further, since the first hydraulic device doubles as the whole or part of the second hydraulic device, an independent (additional) pressure equalizing hydraulic device becomes unnecessary, whereby costs for the entire system can be suppressed.

According to a fourth aspect of the invention, in the die cushion device with a cushion pin pressure equalizing function, it is preferable that the first hydraulic device and the second hydraulic device commonly share a first hydraulic pump/motor having a discharge port connected to the ascending-side pressurizing chamber of the hydraulic cylinder and the ascending-side pressurizing chambers of the hydraulic cylinder group via a piping, and a first servomotor connected to a rotational shaft of the first hydraulic pump/motor.

According to a fifth aspect of the invention, it is preferable that the die cushion device with a cushion pin pressure equalizing function includes a valve device configured to connect the discharge port of the first hydraulic pump/motor with the ascending-side pressurizing chamber of the hydraulic cylinder and disconnect the discharge port of the first hydraulic pump/motor from the ascending-side pressurizing chambers of the hydraulic cylinder group, when the first hydraulic device is controlled by the first controller, and configured to disconnect the discharge port of the first hydraulic pump/motor from the ascending-side pressurizing chamber of the hydraulic cylinder and connect the discharge port of the first hydraulic pump/motor with the ascending-side pressurizing chambers of the hydraulic cylinder group, when the second hydraulic device is controlled by the second controller.

The first hydraulic pump/motor and the first servomotor are switched over by the valve device so as to be used as the first hydraulic device for the die cushion or the second hydraulic device for the pressure equalization, whereby the first hydraulic pump/motor and the first servomotor can be used commonly by the first hydraulic device and the second hydraulic device.

According to a sixth aspect of the invention, in the die cushion device with a cushion pin pressure equalizing function, it is preferable that the second controller controls the first servomotor so that the pressure in the ascending-side pressurizing chambers of the hydraulic cylinder group becomes the initial pressure while the cushion pad is waiting in one operation cycle of the press machine, except a pressing process and a knockout process.

According to a seventh aspect of the invention, in the die cushion device with a cushion pin pressure equalizing function, preferably, the first hydraulic device includes a second hydraulic pump/motor having a discharge port connected to the ascending-side pressurizing chamber of the hydraulic cylinder via a piping; and a second servomotor connected to a rotational shaft of the second hydraulic pump/motor, and the first controller controls only the second servomotor to control a position of the cushion pad while the cushion pad is waiting during a period of time when the first servomotor is controlled by the second controller, and controls both the first servomotor and the second servomotor during at least a pressing process in one operation cycle of the press machine.

Since a large power needs to be generated for the application of the die cushion load compared with the application of the initial pressure during the pressing process in the one operation cycle of the press machine, both the first servomotor and the second servomotor are used.

Then, by further including the second hydraulic pump/motor and the second servomotor, even during the period of time when the initial pressure in the ascending-side pressurizing chambers of the hydraulic cylinder group is controlled by driving the first servomotor, the position of the hydraulic cylinder (the position of the cushion pad while the cushion pad is waiting) can be continuously controlled by driving the second servomotor that is not used for controlling the initial pressure. On the other hand, during the pressing process in the one operation cycle of the press machine, the large power associated with the application of the die cushion load can be generated by driving both the first servomotor and the second servomotor.

According to an eighth aspect of the invention, in the die cushion device with a cushion pin pressure equalizing function, it is preferable that the hydraulic cylinder configured to support the cushion pad is provided in plurality, the hydraulic cylinder group is divided into a plurality of hydraulic cylinder groups respectively corresponding to the plurality of the hydraulic cylinders configured to support the cushion pad, and the ascending-side pressurizing chambers of each of the plurality of hydraulic cylinder groups are in communication with each other, the first pressure detector detects respectively pressures in the ascending-side pressurizing chambers of the plurality of the hydraulic cylinders, the second pressure detector detects pressures in the ascending-side pressurizing chambers respectively for the plurality of hydraulic cylinder groups, the initial pressure setting unit can set initial pressures in the ascending-side pressurizing chambers respectively for the plurality of hydraulic cylinder groups, the first hydraulic pump/motor and the first servomotor are provided for each of the plurality of hydraulic cylinders, the first controller controls the plurality of first servomotors based on the pressure detected by the first pressure detector during at least the pressing process in one operation cycle of the press machine so that die cushion loads generated by the plurality of the hydraulic cylinders become target die cushion loads that are set individually, and the second controller individually controls the plurality of first servomotors based on the pressures detected by the second pressure detector while the cushion pad is waiting in one operation cycle of the press machine, except the pressing process and the knockout process so that the pressures in the ascending-side pressurizing chambers of the plurality of hydraulic cylinder groups become the initial pressures that can be set respectively for the plurality of hydraulic cylinder groups.

According to the eighth aspect of the invention, the die cushion loads can individually controlled so as to become the target die cushion loads that can individually be set for each of the plurality of hydraulic cylinders. In addition, the initial pressure can be set for the ascending-side pressurizing chambers of each hydraulic cylinder group of the plurality of hydraulic cylinder groups that individually correspond to the plurality of hydraulic cylinders. By adopting this configuration, necessary die cushion loads can be applied to parts of a die for a product shaped differently, whereby the forming quality can be improved.

According to a ninth aspect of the invention, there is provided a cushion pin pressure equalizing method for a die cushion device including a plurality of cushion pins inserted through a bolster of a press machine, a cushion pad configured to support a blank holder via the plurality of cushion pins, a die cushion load generator configured to generate a die cushion load to be applied to the cushion pad, and a die cushion controller configured to control the die cushion load generator so that the die cushion load generated by the die cushion load generator becomes a set target die cushion load, the cushion pin pressure equalizing method including: preparing a hydraulic cylinder group provided on the cushion pad in which lower ends of the cushion pins that are inserted through the bolster are brought into abutment with piston rods of the hydraulic cylinder group, and ascending-side pressurizing chambers of the hydraulic cylinder group are in communication with each other; setting an initial pressure for the ascending-side pressurizing chambers of the hydraulic cylinder group; and controlling a pressure of a working fluid sealed in the ascending-side pressurizing chambers of the hydraulic cylinder group so that a pressure in the ascending-side pressurizing chambers of the hydraulic cylinder group becomes the set initial pressure while the cushion pad is waiting in one operation cycle of the press machine, wherein, in the setting of the initial pressure, the initial pressure is set based on a total volume of the ascending-side pressurizing chambers of the hydraulic cylinder group and a pipe line, a minimum volume change amount of the ascending-side pressurizing chambers of the hydraulic cylinder group when a variation in height of the plurality of cushion pins is absorbed and a volume elastic modulus of the working fluid so that a pressure of the working fluid that increases when the total volume of the working fluid having the initial pressure is compressed by the volume change amount becomes a pressure corresponding to a lowest die cushion load of the set target die cushion load.

According to a tenth aspect of the invention, in the cushion pin pressure equalizing method, it is preferable that the die cushion load generator includes: a hydraulic cylinder configured to generate a die cushion load to be applied to the cushion pad; and a hydraulic device configured to supply working fluid to an ascending-side pressurizing chamber of the hydraulic cylinder or to discharge the working fluid from the ascending-side pressurizing chamber, and in the setting of an initial pressure, the pressure in the ascending-side pressurizing chambers of the hydraulic cylinder group is controlled so as to become the initial pressure by using the hydraulic device while the cushion pad is waiting.

According to the invention, by setting the initial pressure in the ascending-side pressurizing chambers of the pressure equalizing hydraulic cylinder group for absorbing the variation in height of the plurality of cushion pins to the proper pressure, after the slide collides against the cushion pad, the variation in height of the plurality of cushion pins can be absorbed within the shortest stroke of the slide (within the shortest time), whereby the blank holder load (the die cushion load) applied to the individual cushion pins can be equalized. Thus, when controlling the die cushion load generator so that the set target die cushion load is generated, the response to application of the die cushion load (the blank holder load) can be stabilized without excessive delay.

DETAILED DESCRIPTION OF THE EMBODIMENTS

Hereinafter, referring to accompanying drawings, preferred embodiments of a cushion pin pressure equalizing device, a die cushion device with a cushion pin pressure equalizing function, and a cushion pin pressure equalizing method according to the invention will be described.

<Press System>

Figure 1:
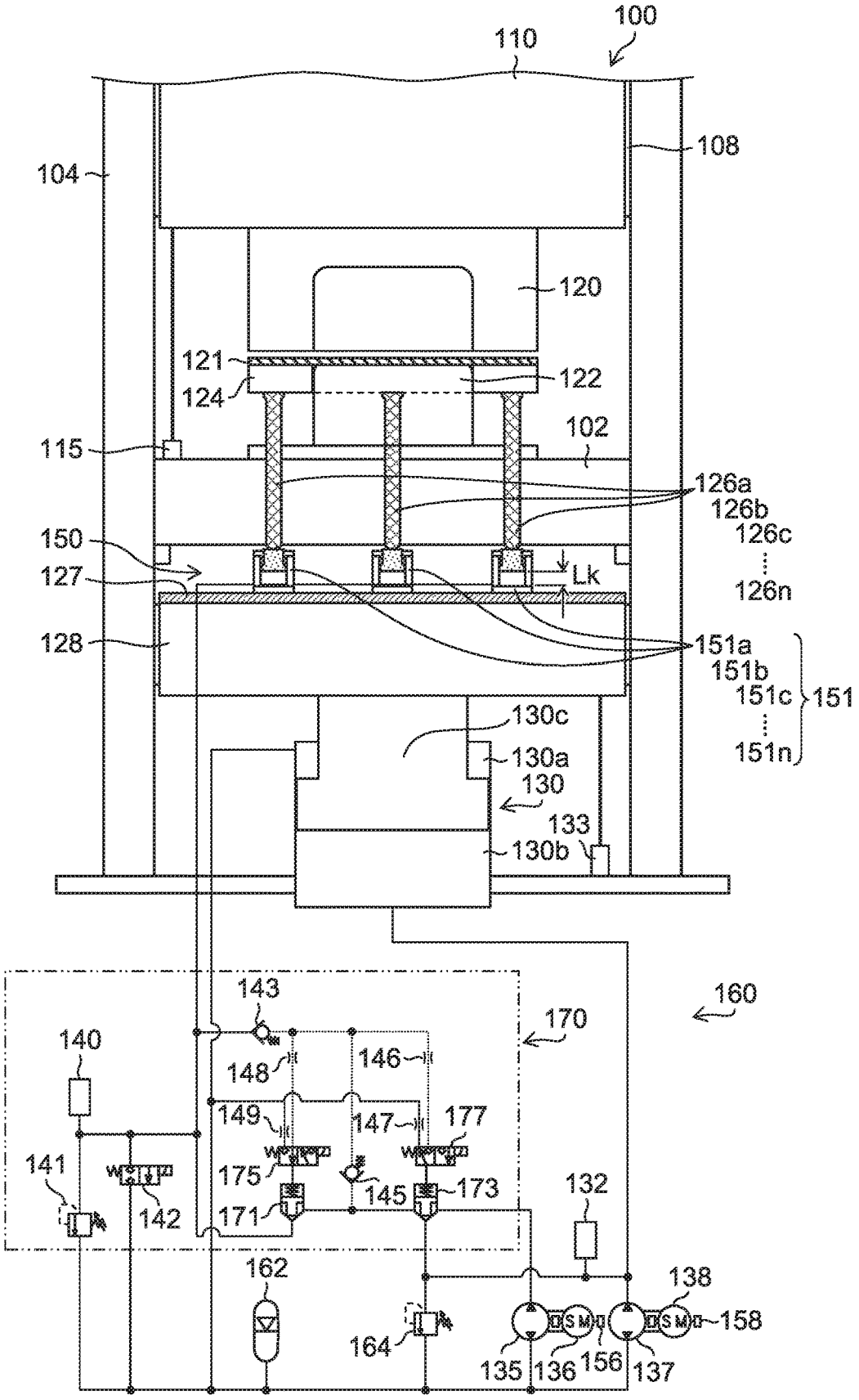
FIG. 1 is a main block diagram illustrating a press system including a die cushion device with a cushion pin pressure equalizing function according to a first embodiment of the present invention.

FIG. 1 is a main block diagram illustrating a press system including a die cushion device with a cushion pin pressure equalizing function according to a first embodiment of the present invention.

<Press Machine>

In a press machine 100 illustrated in FIG. 1, a frame includes a bed 102, columns 104 and the like, and a slide 10 is movably guided in a vertical direction by sliding members 108 provided on the columns 104. The slide 110 is moved in the up-and-down direction in FIG. 1 by a crank mechanism including a crankshaft to which a rotational driving force is transmitted by a drive device, not shown.

A slide position detector 115 configured to detect a height position of the slide 110 is provided on the bed 102 of the press machine 100.

An upper die 120 is mounted on the slide 110, and a lower die 122 is mounted on (a bolster of) the bed 102.

<First Embodiment of Die Cushion Device with Cushion Pin Pressure Equalizing Function>

The die cushion device with a cushion pin pressure equalizing function according to the first embodiment illustrated in FIG. 1 includes a cushion pin pressure equalizing device 150 and a die cushion device 160.

The die cushion device 160 includes: a plurality of (n number of) (n: any positive integer greater than one) cushion pins 126*a*, 126*b*, 126*c*, . . . , 126*n*; a cushion pad 128; a hydraulic cylinder 130; a first hydraulic device; and a first controller (a die cushion controller 181 in FIG. 3, which will be described later). The plurality of cushion pins 126*a*, 126*b*, 126*c*, . . . , 126*n* are inserted through the bed 102 and the bolster on the bed 102 of the press machine 100. The cushion pad 128 is configured to support a blank holder 124 via the n number of cushion pins 126, 126*b*, 126*c*, . . . , 126*n*. The hydraulic cylinder 130 is configured to support the cushion pad 128 and functions as a die cushion load generator configured to generate a die cushion load in the cushion pad 128. The first hydraulic device is configured to supply a working fluid to an ascending-side pressurizing chamber 130*b* which constitutes a hydraulic chamber on the head side of the hydraulic cylinder 130 or discharge the working fluid from the ascending-side pressurizing chamber 130*b*. The first controller is configured to control the first hydraulic device so that the die cushion load generated mainly from the hydraulic cylinder 130 becomes a set target die cushion load.

The hydraulic cylinder 130 has a piston rod 130*c* connected to a lower surface of the cushion pad 128 and is used to drive the die cushion. The hydraulic cylinder 130 generates a die cushion load to be applied to the cushion pad 128 mainly during a die cushion load application process and raises the cushion pad 128 to a standby position during a knockout process.

The first hydraulic device includes a first pressure detector 132, a first hydraulic pump/motor (a first hydraulic pump/motor) 135 and a second hydraulic pump/motor (a second hydraulic pump/motor) 137 both of which are a fixed displacement type, a first servomotor 136 and a second servomotor 138 respectively shaft connected to rotational shafts of the first hydraulic pump/motor 135 and the second hydraulic pump/motor 137, encoders 156, 158 respectively provided on drive shafts of the first servomotor 136 and the second servomotor 138, an accumulator 162, and a relief valve 164.

One port (a hydraulic pressure connection port) of the first hydraulic pump/motor 135 is connected to a rod-side hydraulic chamber 130*a* of the hydraulic cylinder 130 via a low pressure line to which the accumulator 162 is connected, and another port is configured to be connectable to the ascending-side pressurizing chamber 130*b* of the hydraulic cylinder 130 via a second logic valve 173.

One port of the second hydraulic pump/motor 137 is connected to the rod-side hydraulic chamber 130*a* of the hydraulic cylinder 130 via a low pressure line, and another port is connected to the ascending-side pressurizing chamber 130*b* of the hydraulic cylinder 130.

The accumulator 162 holds a substantially constant pressure (a system pressure) of the order of 5 to 10 kg/cm$^2$. The accumulator 162 performs a function corresponding to a tank of a general hydraulic device.

The relief valve 164 acts on the ascending-side pressurizing chamber 130*b* of the hydraulic cylinder 130 and functions as a safety valve for the die cushion device.

The first pressure detector 132 detects a pressure applied to the ascending-side pressurizing chamber 130*b* of the hydraulic cylinder 130 and is mainly used to control a pressure corresponding to a die cushion load.

A die cushion position detector 133 is configured to detect a position (a die cushion position) of the cushion pad 128, and is provided in the die cushion device 160. The die cushion position detector 133 is used mainly to control the position of the die cushion (the cushion pad 128).

The first servomotor 136 and the second servomotor 138 are basically used to drive the die cushion through one cycle of the press machine 100. In addition, the first servomotor 136 is used for generating an initial pressure for the cushion pin pressure equalizing device 150 near a time point when the cushion pad 128 is kept in a standby position (a slide position when a die cushion load control starts) in one operation cycle of the press machine 100.

Figure 3:
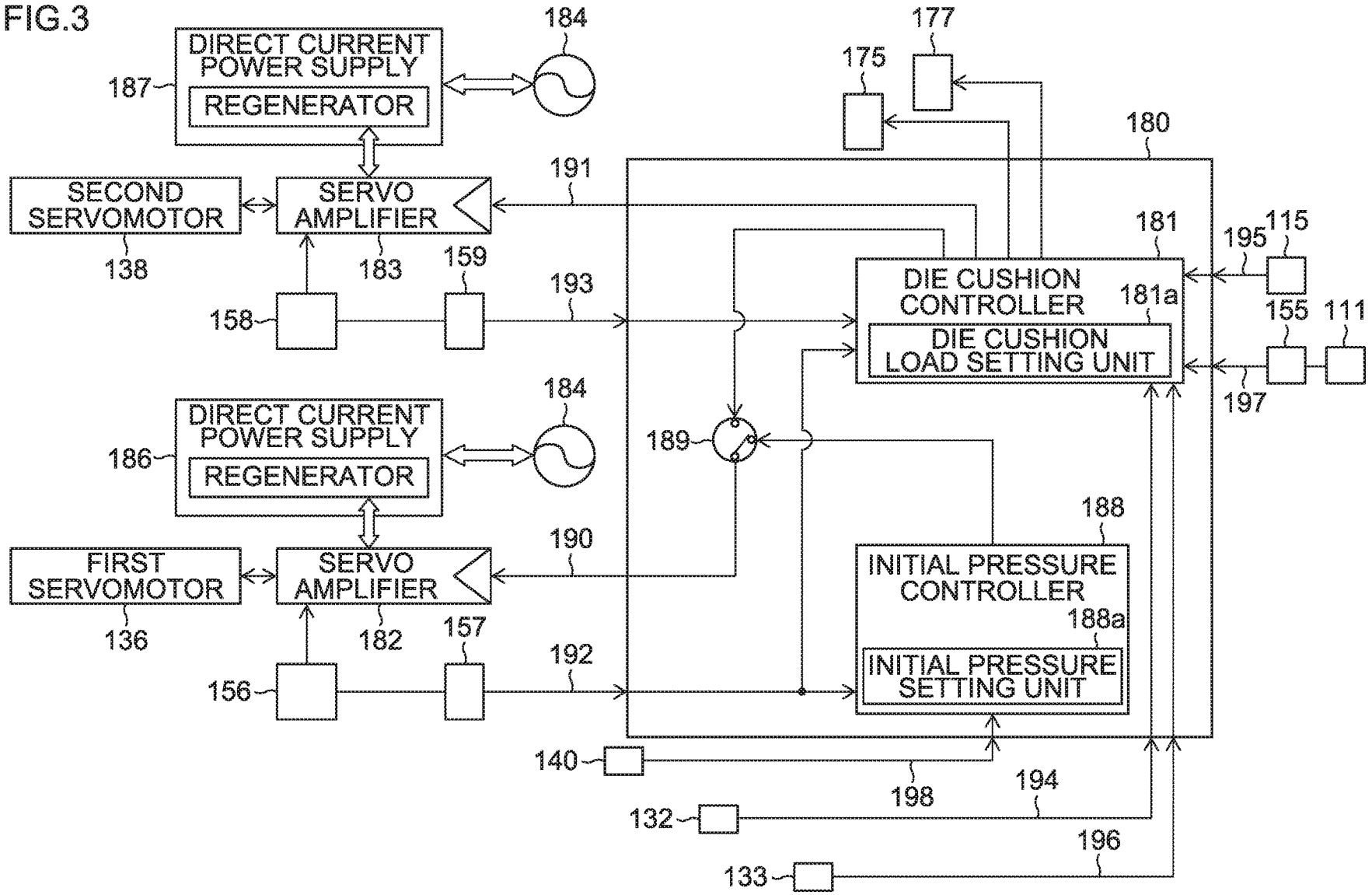
FIG. 3 is a block diagram mainly illustrating a first embodiment of a control device that is applied to the die cushion device with a cushion pin pressure equalizing function according to the first embodiment illustrated in FIG. 1.

The cushion pin pressure equalizing device 150 includes: a hydraulic cylinder group (a hydraulic cylinder group) 151 including a plurality of (n number of) cushion pin pressure equalizing hydraulic cylinders 151*a*, 151*b*, 151*c*, . . . , 151*n*; a second hydraulic device (a second hydraulic device); and a second controller (an initial pressure controller) 188 (see FIG. 3). The second hydraulic device is configured to supply the working fluid to the ascending-side pressurizing chambers of the hydraulic cylinder group 151 or discharge the working fluid from the ascending-side pressurizing chambers. The second controller 188 includes an initial pressure setting unit 188*a* and is configured to control the second hydraulic device so that a pressure in the ascending-side pressurizing chambers of the hydraulic cylinder group 151 becomes a set initial pressure.

The hydraulic cylinder group 151 is disposed on (a pin plate 127 of) the cushion pad 128 such that at least one hydraulic cylinder is respectively positioned below a projection plane of the n number of cushion pins 126*a*, 126*b*, 126*c*, . . . , 126*n* which are inserted through the bed 102 and the bolster on the bed 102, and respective lower ends of the cushion pins can be brought into contact with piston rods of the hydraulic cylinder group 151 (a step of preparing a hydraulic cylinder group). Additionally, the ascending-side pressurizing chambers of the hydraulic cylinder group 151 are in communication with each other via a piping.

In this embodiment, the number of hydraulic cylinder groups 151 is equal to the number of cushion pins, that is, the n number of cushion pins 126*a*, 126*b*, 126*c*, . . . , 126*n*. However, the number of hydraulic cylinder groups 151 may be larger than the number of cushion pins that are actually used. This is because, although the number and arrangement of cushion pins that are inserted through the bolster can be appropriately set according to a die to be used and so on, one cushion pin pressure equalizing hydraulic cylinder exists below the projection plane of each cushion pin without fail, regardless of the number and arrangement of the cushion pins. It is preferable that, even in this case, only the ascending-side pressurizing chambers of the n number of cushion pin pressure equalizing hydraulic cylinders corresponding to the n number of cushion pins that are actually used are in communication with each other by a piping, and the cushion pin pressure equalizing hydraulic cylinders that are not used are disconnected from the hydraulic circuit. This is because a total volume of working fluid used for pressure control is made as small as possible.

The second hydraulic device includes a cushion pin pressure equalizing hydraulic circuit 170, the first hydraulic pump/motor 135, and the first servomotor 136 which is shaft connected to a rotational shaft of the first hydraulic pump/motor 135.

Here, the first hydraulic pump/motor 135 and the first servomotor 136, which are provided in the second hydraulic device, are commonly used for the first hydraulic device which supplies the working fluid to the ascending-side pressurizing chamber 130*b* of the hydraulic cylinder 130 or discharges the working fluid from the ascending-side pressurizing chamber 130*b*.

The cushion pin pressure equalizing hydraulic circuit 170 includes a second pressure detector 140, a relief valve 141, a first solenoid valve 175, a second solenoid valve 177, check valves 143, 145, throttle valves 146, 147, 148, 149, a first logic valve 171, and a second logic valve 173.

The second pressure detector 140 is used to detect a pressure applied to the ascending-side pressurizing chambers of the hydraulic cylinder group 151 and to control mainly an initial pressure ($P_{ko}$) for cushion pin pressure equalization. The relief valve 141 acts on the hydraulic cylinder group 151 and functions as a safety valve for the cushion pin pressure equalizing device. The solenoid valve 142 is used to safely relief a pressure acting on (held on) the hydraulic cylinder group 151 when the machine is not used.

The first logic valve 171 and the second logic valve 173 are opened or closed by the first solenoid valve 175 and the second solenoid valve 177, respectively. The first logic valve 171 and the second logic valve 173 function as a valve device configured to switch modes between a mode for driving the hydraulic cylinder 130 by the first hydraulic pump/motor 135 that is shaft connected to the first servomotor 136 and a mode for driving the hydraulic cylinder group 151 by the first hydraulic pump/motor 135.

The first solenoid valve 175 closes/opens the first logic valve 171 when it is turned OFF/ON, and the second solenoid valve 177 opens/closes the second logic valve 173 when it is turned OFF/ON. When the first solenoid valve 175 and the second solenoid valve 177 are off (normal), the mode is in a base mode for driving the die cushion device. A (pilot) pressure is applied to pilot ports of the first logic valve 171 and the second logic valve 173 via the first solenoid valve 175 and the second solenoid valve 177. Among a pressure applied to the hydraulic cylinder group 151 via the check valve 143 and a discharge pressure of the first hydraulic pump/motor 135 via the check valve 145, the larger pressure is selected as the pilot pressure.

When both the first solenoid valve 175 and the second solenoid valve 177 are off, the first logic valve 171 is closed, and the second logic valve 173 are opened, whereby the mode is switched to the mode for driving the hydraulic cylinder 130. That is, a discharge port of the first hydraulic pump/motor 135 and the ascending-side pressurizing chamber 130*b* of the hydraulic cylinder 130 communicate with each other through the second logic valve 173 and the piping, while the discharge port of the first hydraulic pump/motor 135 is disconnected from the ascending-side pressurizing chamber of the hydraulic cylinder group 151.

On the other hand, when both the first solenoid valve 175 and the second solenoid valve 177 are on, the first logic valve 171 is opened and the second logic valve 173 is closed, whereby the mode is switched to the mode for driving the hydraulic cylinder group 151. That is, the discharge port of the first hydraulic pump/motor 135 and the ascending-side pressurizing chamber of the hydraulic cylinder group 151 communicate with each other through the first logic valve 171, the second logic valve 173 and the piping, whereas the discharge port of the first hydraulic pump/motor 135 is disconnected from the ascending-side pressurizing chamber 130*b* of the hydraulic cylinder 130.

<<Initial Pressure>>

Next, an initial pressure that is a sealing pressure in the ascending-side pressurizing chambers of the cushion pin pressure equalization hydraulic cylinder group 151 will be described.

In this invention, average contraction amount ($\Delta L_k$) of the cushion pin pressure equalization hydraulic cylinder group 151, which is a necessary minimum amount to absorb a variation in length of the plurality of cushion pins and an inclination of the cushion pad, is generated by making use of the elasticity specific (intrinsic) to the working fluid, without adding any special elastic element. In order to generate the average contraction amount ($\Delta L_k$), according to the present embodiment, an initial pressure ($P_{kL0}$) in the ascending-side pressurizing chambers of the hydraulic cylinder group 151 is highly accurately (accuracy around a range of the initial pressure target value $P_{k0r}$±0.1 kg/cm$^2$) controlled based on a lowest die cushion load ($F_L$). In association with this, the operation response of the die cushion load (a blank holder load) can be stabilized without excessive delay. This will be described as below while illustrating a specific example.

Firstly, in this example, the cushion pin pressure equalizing hydraulic cylinder group 151, the piping establishing the communication therebetween, and the working fluid are assumed as below.

Sectional Area of Each Hydraulic Cylinder $S_k$ [cm$^2$]: 28.27 (corresponding to a cylinder diameter of 6 cm)

Number of Hydraulic Cylinders n: 30

Total Sectional Area of Hydraulic Cylinder Group $\Sigma S_k$ [cm$^2$]:

$$\Sigma S_k = n \times S_k = 848.1$$

Overall Stroke of Hydraulic Cylinder $L_k$ [cm]: 5

Inside Diameter d [cm] and Length 1 [cm] of Piping: 2.5 and 500

Total Volume of Hydraulic Cylinder Group and Piping $V_k$ [cm$^3$]:

$$V_k = \Sigma S_k \times L_k + d^2 \times \pi/4 \times 1 \approx 6695$$

(Actual) Volume Elastic Modulus of Working Fluid K [kg/cm$^2$]: 10000

Figure 2:
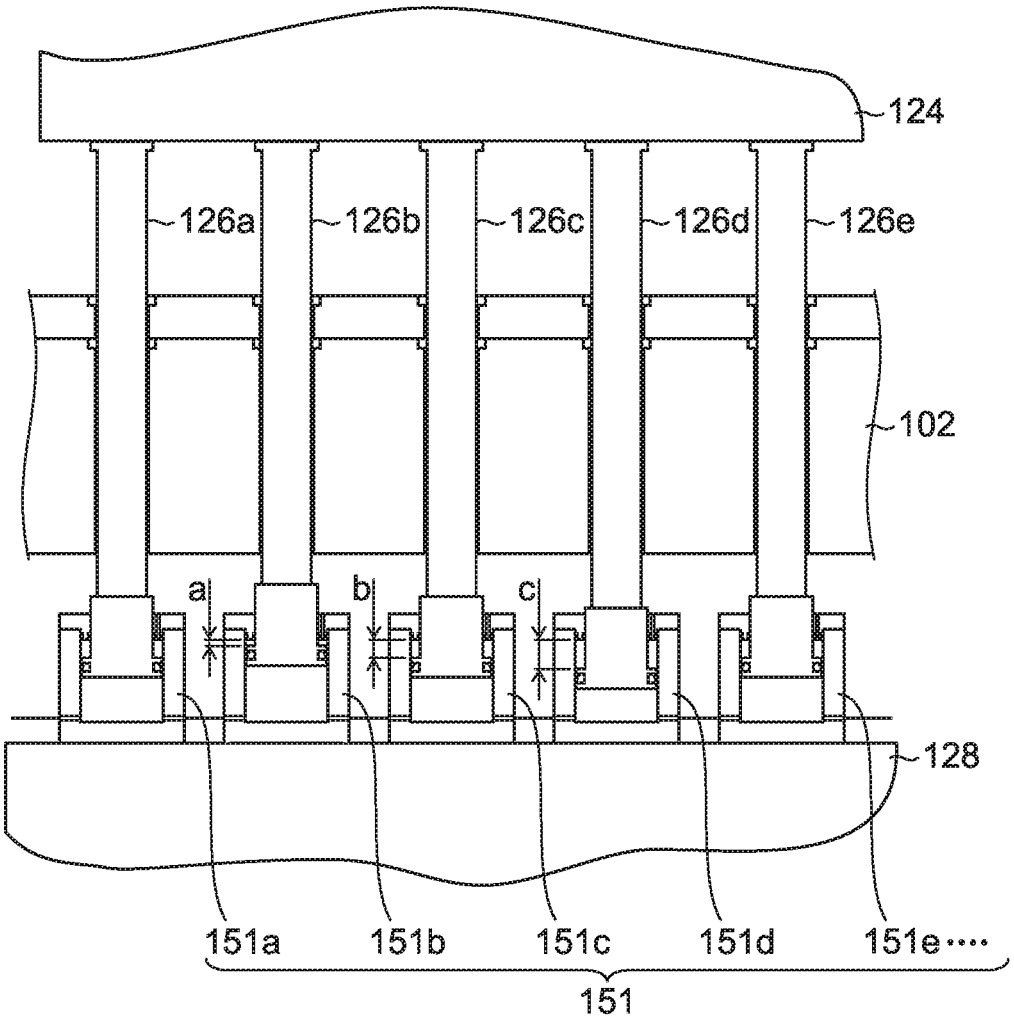
FIG. 2 is a drawing illustrating a variation in height (length) of a plurality of cushion pins 126*a*, 126*b*, . . . , 126*n*.

Next, in this example, a variation in height (length) of the plurality of (n umber of) cushion pins is assumed as illustrated in FIG. 2.

FIG. 2 is a drawing illustrating a variation in height (length) of the plurality of cushion pins 126*a*, 126*b*, . . . , 126*n*.

In an example illustrated in FIG. 2, the cushion pad 128 and the blank holder 124 are not inclined. There are 30 cushion pins. In these 30 cushion pins, it is assumed that 16 cushion pins including cushion pins 126*a*, 126*c*, 126*e* have a predetermined length, that 10 cushion pins including a cushion pin 126*d* have a length that is 1.0 mm longer than the predetermined length, and that 4 cushion pins including a cushion pin 126*b* have a length that is 0.6 mm shorter than the predetermined length.

In a state illustrated in FIG. 2, a contraction amount b of a piston rod of a cushion pin pressure equalizing hydraulic cylinder 151*c* where a lower end of the cushion pin 126*c* is brought into abutment with the piston rod is 0.75 mm, a contraction amount c of a piston rod of a hydraulic cylinder 151*d* where a lower end of the cushion pin 126*d* is brought into abutment with the piston rod is 1.75 mm, and a contraction amount a of a piston rod of a hydraulic cylinder 151*b* where a lower end of the cushion pin 126*b* is brought into abutment with the piston rod is 0.15 mm.

Consequently, the cushion pin 126*d* is 1.0 (=1.75−0.75) mm longer than the cushion pin 126*c* having the predetermined length, and the cushion pin 126*b* is 0.6 (=0.75−0.15) mm shorter than the cushion pin 126*c* having the predetermined length.

In the case where there is a variation in length of the cushion pins as described above, when the press machine 100 starts pressing, firstly, the cushion pins that are 1 mm longer come into contact with the blank holder 124 between the cushion pad 128 and the blank holder 124, next, the cushion pins that have the predetermined length come into contact, and lastly the cushion pins that are 0.6 mm shorter come into contact.

The cushion pin pressure equalizing hydraulic cylinder group 151 has to be contracted in average by $\{(1.0+0.6)\times 10+0.6\times 16\}/30=0.85$ mm at a time point when the short cushion pins come into contact with the blank holder 124. In order to equalize the pressures of all the cushion pins in an ensured fashion, all the cushion pins have to be compressed further on average after the short cushion pins have come into contact with the blank holder 124. Assuming that an average additional (extra) contraction amount is 0.15 mm, a necessary average contraction amount $\Delta L_k$ [cm] of hydraulic cylinder group 151 is 0.85+0.15=1 mm in order to equalize the pressures of the cushion pins.

Next, assuming that a lowest die cushion load ($F_L$) during a pressing process by the press machine 100 is 2000 [kN], a pressure ($P_{kLD}$) corresponding to the lowest die cushion load resulting when the lowest die cushion load ($F_L$) is applied is 240.6 [kg/cm$^2$] as will be expressed below.

$$P_{kLD}=1000\times F_L/g/\Sigma S_k\approx 240.6$$

In addition, the initial pressure ($P_{kL0}$ [kg/cm$^2$]) can be calculated by [Expression 1] below, $$P_{kL0}=P_{kLD}-K\times\Delta L_k\times\Sigma S_k/V_k, \text{ and in this example } P_{kL0}\approx 113.9[\text{kg/cm}^2]. \quad \text{[Expression 1]}$$

The initial pressure ($P_{kL0}$) that satisfies the pressure ($P_{kLD}$) corresponding to the lowest die cushion load calculated from the lowest die cushion load ($F_L$) and the necessary average contraction amount ($\Delta L_k$) of the hydraulic cylinder group 151 is calculated as 113.9 [kg/cm$^2$] using [Expression 1] that is established when assuming that the compressibility of the working fluid is constant with the volume elastic modulus K in the environment surrounding this example. The initial pressure ($P_{kL0}$) in the pressure generating chambers of the cushion pin pressure equalizing hydraulic cylinder group 151 should be set accurately to be 113.9 [kg/cm$^2$].

The reason that the initial pressure ($P_{kL0}$) is calculated and set based on the lowest die cushion load ($F_L$) is to satisfy the contraction amount ($\Delta L_k$) necessary to absorb the variation in height of the plurality of cushion pins. For the purpose of illustration, a die cushion load (F*) is assumed to be 3000 [kN]. The die cushion load (F*) of 3000 [kN] is not the lowest die cushion load, but can be generated during the pressing process in this example. Based on the die cushion load (F*), when an initial pressure ($P_{k*0}=361.0-K\times(\Delta L_k)\times\Sigma S_k/V_k=234.3$) is calculated by use of a pressure $P_{k*D}$ [kg/cm$^2$]($=1000\times F^*/g/\Sigma S_k\approx 361.0$) corresponding to the die cushion load (F*), in place of $P_{kLD}$ of [Expression 1], and then the calculated initial pressure is applied, a contraction amount ($\Delta L_{k*}$) at a time point when the lowest die cushion load (2000 [kN]) is applied can be calculated by the following expression corresponding to [Expression 1], $$(\Delta L_{k*})=V_k(P_{kD}-P_{k0})/K/\Sigma S_k. \quad \text{[Expression 2]}$$

When substituting the pressure ($P_{kD}$) corresponding to the generalized die cushion load in [Expression 2] by the pressure $P_{kLD}$ (=240.6 [kg/cm$^2$]) which corresponds to the lowest die cushion load and substituting the generalized initial pressure ($P_{k0}$) by $P_{k*0}$ (≈234.3 [kg/cm$^2$]), the contraction amount ($\Delta L_{k*}$) is calculated as 0.005 [cm] (0.05 [mm]). In this case, the contraction amount ($\Delta L_k$) of 1 mm that is necessary to absorb the variation in height of the plurality of cushion pins is not satisfied, and the cushion pin pressure equalizing effect is lost when the die cushion load is changed to the lowest die cushion load during the pressing process.

Thus, when the initial pressure ($P_{kL0}$), which satisfies both the pressure ($P_{kLD}$) corresponding to the lowest die cushion load ($F_L$) (that is, calculated from the lowest die cushion load) and the contraction amount ($\Delta L_k$) that is necessary for cushion pin pressure equalization by the hydraulic cylinder group 151, is calculated and is then applied "accordingly," the pressure equalizing effect of the plurality of cushion pins can be ensured over the whole regions of the pressing process, and the response to application of the die cushion load (the blank holder load) can be stabilized without excessive delay.

<First Embodiment of Control Device>

FIG. 3 is a block diagram mainly illustrating a first embodiment of a control device that is applied to the die cushion device with a cushion pin pressure equalizing function according to the first embodiment illustrated in FIG. 1.

A control device 180 illustrated in FIG. 3 includes a die cushion controller (a first controller) 181 configured to control the first hydraulic device that drives the die cushion hydraulic cylinder 130, and an initial pressure controller (a second controller) 188 configured to control the second hydraulic device that drives the cushion pin pressure equalizing hydraulic cylinder group 151.

<Die Cushion Controller>

The die cushion controller 181 is a controller configured to control the cushion pad position and the die cushion load, and includes a die cushion load setting unit (die cushion load setter) 181*a*.

The die cushion controller 181 receives: a die cushion pressure signal 194 indicating a pressure in the ascending-side pressurizing chamber 130*b* of the hydraulic cylinder 130 that is detected by the first pressure detector; a die cushion position signal 196 indicating a position of the cushion pad 128 that is detected by the die cushion position detector 133; a slide position signal 195 indicating a position of the slide 110 that is detected by the slide position detector 115; a slide speed signal 197 indicating a speed of the slide 110 that is generated from a crank angle signal of an angle detector (an angle detector configured to detect an angle of a crankshaft configured to drive the slide 110) 111 via a signal converter 155; and servomotor angular velocity signals 192, 193 that are generated from the encoders 156, 158 configured to detect angles of the first servomotor 136 and the second servomotor 138 via signal converters 157, 159, respectively.

The die cushion controller 181 determines whether the slide 110 is in a non-pressing process area or whether the slide 110 is in a pressing process area based on the slide position signal 195 or a crank angle signal, not shown. When the die cushion controller 181 determines that the slide 110 is in the non-pressing process area, the die cushion controller 181 switches the mode to a die cushion position controlling mode where the cushion pad position is controlled, whereas it determines that the slide 110 is in the pressing process area, the die cushion controller 181 switches its mode to a die cushion load (pressure) controlling mode.

<Die Cushion Position Control>

In the die cushion position controlling mode, the die cushion controller 181 calculates torque commands 190, 191 based on a die cushion position command from a die cushion position command unit, not shown, servomotor angular velocity signal 192, 193 of the first servomotor 136 and the second servomotor 138, and the slide position signal 195. The die cushion controller 161 controls the first servomotor 136 and the second servomotor 138 via servo amplifiers 182, 183 using the torque commands 190, 191, and supplies the pressurized working fluid from the first hydraulic pump/motor 135 and the second hydraulic pump/motor 137 to the ascending-side pressurizing chamber 130 of the hydraulic cylinder 130.

Thus, a position of the piston rod 130*c* of the hydraulic cylinder 130 can be controlled in relation to a direction in which the piston rod 130*c* is extended or contracted, whereby a height position of the cushion pad 128 (a die cushion position) can be controlled.

The die cushion command unit receives the die cushion position signal and uses the die cushion position signal in order to generate an initial value in generation of the due cushion position command. The die cushion position command unit executes a product knockout operation after the slide 110 reaches its bottom dead center and the die cushion load control ends. In addition, the die cushion position command unit outputs the die cushion position command to control a height position of the cushion pad 128 so as to keep the cushion pad 128 waiting in the die cushion standby position which is an initial position of the cushion pad 128.

<<Die Cushion Load Control Principle>>

The die cushion load can be expressed by a product of the pressure of the ascending-side pressurizing chamber 130*c* and a cylinder area of the hydraulic cylinder 130. Therefore, control of the die cushion load means control of the pressure in the ascending-side pressurizing chamber 130*b* of the hydraulic cylinder 130.

Now, it is assumed that:

Area of hydraulic cylinder on die cushion pressure generation side: a

Volume of hydraulic cylinder on die cushion pressure generation side: V

Die cushion pressure: P

Load torque of hydraulic motor: t

Drive torque of servomotor: T

Inertia moment of servomotor: I

Viscosity resistance coefficient of servomotor: DM

Friction torque of servomotor: fM

Displacement volume of hydraulic motor: Q

Force applied from slide to hydraulic cylinder piston rod: $F_{slide}$

Pad speed generated by being pushed by press: v

Inertia mass of hydraulic cylinder piston rod and pad: M

Viscosity resistance coefficient of hydraulic cylinder: DS

Friction force of hydraulic cylinder: fS

Angular velocity of servomotor that rotates by being pushed by working fluid: ω

Volume elastic modulus of working fluid: K, and

Proportional constant: k1, k2.

Then, a static behavior can be expressed by [Expression 3] and [Expression 4].

$$P=\int K((v\cdot A-2\cdot k1\cdot Q\cdot\omega)/V)dt \text{ (when two hydraulic motors are used)} \quad \text{[Expression 3]}$$

$$t=k2\cdot PQ/(2\pi). \quad \text{[Expression 4]}$$

In addition, a dynamic behavior can be expressed by [Expression 5] and [Expression 6] in addition to [Expression 3] and [Expression 4].

$$PA-F_{slide}=M\cdot dv/dt+DS\cdot v+fS \quad \text{[Expression 5]}$$

$$T-t=I\cdot d\omega/dt+DM\cdot\omega+fM \quad \text{[Expression 6]}$$

The meaning of [Expression 3] to [Expression 6], that is, a force (a die cushion load) transmitted from the slide 110 to the hydraulic cylinder 130 via the cushion pad 128, compresses the ascending-side pressurizing chamber 130*b* of the hydraulic cylinder 130, to thereby generate a die cushion pressure.

In the example illustrated in FIG. 3, to generate the die cushion pressure, the first hydraulic pump/motor 135 and the second hydraulic pump/motor 137 are caused to operate as hydraulic motors. When load torques generated in the first hydraulic pump/motor 135 and the second hydraulic pump/motor 137 resist drive torques of the first servomotor 136 and the second servomotor 138, the first servomotor 136 and the second servomotor 138 are rotated to suppress an increase in pressure. After all, the die cushion pressure is determined according to the drive torques of the first servomotor 136 and the second servomotor 138.

<Die Cushion Load (Pressure) Control>

The die cushion controller 181 includes the die cushion load setting unit 181*a*. The die cushion load setting unit 181*a* outputs a die cushion load (pressure) command that indicates a target die cushion load according to the position of the slide 110 based on the slide position signal 195 detected by the slide position detector 115.

When the die cushion controller 181 is in the die cushion load (pressure) controlling mode, to control the die cushion pressure as instructed by the die cushion pressure command given from the die cushion load setting unit 181*a*, the die cushion controller 181 receives the die cushion pressure signal 194 indicating the pressure of the ascending-side pressurizing chamber 130*b* of the hydraulic cylinder 130 that is detected by the first pressure detector 132.

When the die cushion controller 181 is switched from the die cushion position controlling mode (mode for controlling (holding) the die cushion standby position) to the die cushion pressure controlling mode, the die cushion controller 181 controls the die cushion pressure by outputting torque commands 190, 191 calculated by using the die cushion pressure command, the die cushion pressure signal 194, the servomotor angular velocity signals 192, 193 of the first servomotor 136 and the second servomotor 138, and the slide speed signal 197, to the first servomotor 136 and the second servomotor 138 via the servo amplifiers 182, 183, respectively.

In the die cushion pressure controlling mode, during a descending process (pressing process) from the time when the slide 110 collides against a material (blank) 121 (and the blank holder 124) till the time when the slide 110 reaches the bottom dead center, the torque output directions and generation speeds of the first servomotor 136 and the second servomotor 138 are inverted compared with the period when the slide is ascending. That is, the pressurized working fluid flows from the ascending-side pressurizing chamber 130*b* of the hydraulic cylinder 130 into the first hydraulic pump/motor 135 and the second hydraulic pump/motor 137 by a power that the cushion pad 128 receives from the slide 110, whereby the first hydraulic pump/motor 135 and the second hydraulic pump/motor 137 function as the hydraulic motors. Then, the first servomotor 136 and the second servomotor 138 are driven by the first hydraulic pump/motor 135 and the second hydraulic pump/motor 137, respectively, and operate as generators. Electric power generated by the first servomotor 136 and the second servomotor 138 is regenerated into an alternating current power supply 184, via the servo amplifiers 182, 183 and direct current power supplies 186, 187 having electric power regenerators.

The die cushion controller 181 has a valve controller, not shown, and the valve controller turns ON both the first solenoid valve 175 and the second solenoid valve 177 to open the first logic valve 171 and close the second logic valve 173, near a time point (a time point $T_{Taiki}$) while the cushion pad 128 is waiting (the position controlling mode) in the standby position (the position of the slide when the die cushion load control starts). In addition, for the die cushion position control, the valve controller calculates the torque command 191 for driving only the second servomotor 138 and outputs the torque command 191 to the second servomotor 138 (performs the die cushion position control by using only the second servomotor 138).

In the die cushion controller 181, the servomotor angular velocity signals 192, 193 of the first servomotor 136 and the second servomotor 138 are used to ensure the dynamic stability by improving the pressure phase delay characteristic (i.e., advancing phase) in the die cushion position control and the die cushion pressure control. The slide speed signal 197 is used for control compensation to improve the pressure accuracy. The slide position signal 195 is used to raise the cushion pad 128 while automatically avoiding a collision (an interference) with the slide 110 (for moving function with automatic interference avoidance).

<Initial Pressure Control>

The initial pressure controller 188 includes the initial pressure setting unit 188*a*. As shown in [Expression 1] described above, the initial pressure setting unit 188*a* sets the initial pressure ($P_{kL0}$) based on the minimum volume change amount ($\Delta L_k \times \Sigma S_k$) of the ascending-side pressurizing chambers of the hydraulic cylinder group 151 and the volume elastic modulus (K) of the working fluid so that the pressure of the working fluid that increases when the total volume of the working fluid at the initial pressure is compressed by the volume change amount ($\Delta L_k \times \Sigma S_k$) becomes the pressure ($P_{kLD}$) corresponding to the lowest die cushion load in the target die cushion load set by the die cushion load setting unit 181*a* before application of the die cushion load starts (a step of setting an initial pressure). Here, as explained above, the minimum volume change amount ($\Delta L_k \times \Sigma S_k$) of the ascending-side pressurizing chambers of the hydraulic cylinder group 151 is calculated from the total volume ($V_k$) of the ascending-side pressurizing chambers of the hydraulic cylinder group 151 and the piping, the minimum average contraction amount ($\Delta L_k$) of the hydraulic cylinder group 151 for absorbing the variation in height of the n number of cushion pins 126*a* to 126*n*, and the total sectional area ($\Sigma S_k$) of the hydraulic cylinder group 151.

The initial pressure controller 188 calculates a torque command 190 so that the initial pressure ($P_{kL0}$) that is set by the initial pressure setting unit 188*a* is generated in the ascending-side pressurizing chambers of the hydraulic cylinder group 151 near the time point (the time point $T_{Taiki}$) while the cushion pad 128 is waiting (the position controlling mode) in the standby position (the position of the slide when the die cushion load control starts). This torque command 190 is calculated based on the initial pressure command indicating the initial pressure ($P_{kL0}$) set by the initial pressure setting unit 188*a*, the pressure signal 198 indicating the pressure in the ascending-side pressurizing chambers of the hydraulic cylinder group 151 that is detected by the second pressure detector 140, and the servomotor angular velocity signal 192 generated from the encoder 156 of the first servomotor 136 via the signal converter 157.

The initial pressure controller 188 controls the first servomotor 136 via the servo amplifier 182 based on the calculated torque command 190 and supplies the working fluid from the first hydraulic pump/motor 135 into the ascending-side pressurizing chambers of the hydraulic cylinder group 151 and the piping that communicate with the ascending-side pressurizing chambers of the hydraulic cylinder group 151 via the second logic valve 173 and the first logic valve 171 (a step of controlling the pressure).

Thereby, the pressure in the ascending-side pressurizing chambers of the cushion pin pressure equalizing hydraulic cylinder group 151 is controlled so as to become (match) the initial pressure ($P_{kL0}$) set by the initial pressure setting unit 188*a*.

Here, the valve controller (not shown) of the die cushion controller 181 turns ON both the first solenoid valve 175 and the second solenoid valve 177 to open the first logic valve 171 and close the second logic valve 173 near a time point while the cushion pad 128 is waiting in the standby position. In addition, a torque command selector 189 selects a torque command output from the initial pressure controller 188 as the torque command 190 and outputs the torque command 190 to the first servomotor 136 via the servo amplifier 182 near the time point while the cushion pad 128 is waiting in the standby position.

This controls the initial pressure in the ascending-side pressurizing chambers of the cushion pin pressure equalizing hydraulic cylinder group 151 (and the piping communicating with the ascending-side pressurizing chambers of the cushion pin pressure equalizing hydraulic cylinder group 151) by using the first servomotor 136 and the first hydraulic pump/motor 135 near the time point while the cushion pad 128 is waiting in the standby position. That is, in this example, although the first servomotor 136 and the first hydraulic pump/motor 135 are used mainly for die cushion position control and die cushion pressure control, the first servomotor 136 and the first hydraulic pump/motor 135 are used temporarily to set the pressure in the ascending-side pressurizing chambers of the cushion pin pressure equalizing hydraulic cylinder group 151 to the initial pressure ($P_{kL0}$) while the cushion pad 128 is waiting in the standby position.

In addition, in controlling the initial pressure in the ascending-side pressurizing chambers of the hydraulic cylinder group 151 using the initial pressure controller 188, the servomotor angular velocity signal 192 of the first servomotor 136 is used to improve the pressure phase delay characteristic (i.e., advancing phase) and ensure the dynamic stability.

<Operation of Die Cushion Device with Cushion Pin Pressure Equalizing Function>

Figure 4:
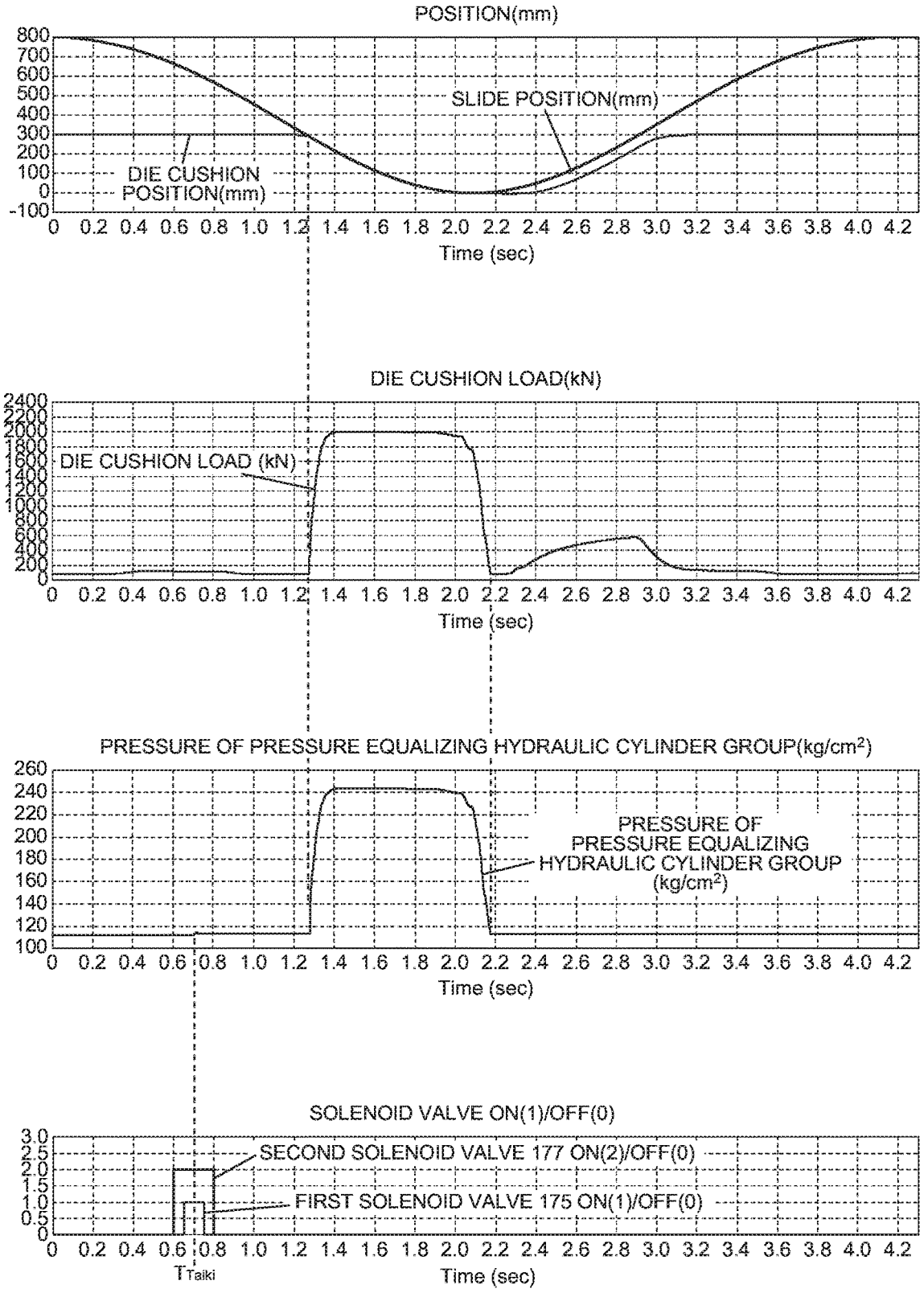
FIG. 4 shows waveforms of main physical quantities in one cycle (during a continuous operation) in the die cushion device with a cushion pin pressure equalizing function according to the first embodiment shown in FIG. 1.

FIG. 4 shows waveforms of main physical quantities in one cycle (during a continuous operation) in the die cushion device with a cushion pin pressure equalizing function according to the first embodiment shown in FIG. 1.

In FIG. 4, a first chart shows a press slide position and a die cushion position, a second chart shows a die cushion load, a third chart shows a pressure in the cushion pin pressure equalizing hydraulic cylinder group 151 in which the ascending-side pressurizing chambers are in communication with each other, and a fourth chart shows ON/OFF states of the first solenoid valve 175 and the second solenoid valve 177.

In this example, it is assumed that a die cushion load value of the target die cushion load that is set by the die cushion load setting unit 181*a* is a constant value of 2000 [kN] (the lowest die cushion load in the pressing process is also the same value), the necessary minimum value of the average contraction amount ($\Delta L_k$) of the cushion pin pressure equalizing hydraulic cylinder group 151 is 1 mm. The initial pressure $P_{kL0}$ of the hydraulic cylinder group 151 (that is calculated in advance within the initial pressure controller 188 and set in the initial pressure setting unit 188*a*) based on the necessary minimum of the average contraction amount ($\Delta L_k$) is 113.9 [kg/cm$^2$]. The initial pressure $P_{k0}$ becomes greater as the setting value of the average contraction amount becomes smaller, and the contraction amount of the hydraulic cylinder group 151 decreases when the die cushion load is applied (the die cushion load response becomes quicker). Therefore, the average contraction amount is desirably set at a necessary minimum value according to the range of variation in length of the plurality of cushion pins.

<0 to about 1.25 s, Press Slide Descends, Die Cushion Standby, and No Pressing is Performed>

The press slide is descending from the top dead center, and no pressing is started yet. The die cushion (cushion pad 128) is waiting in the standby position (the slide position when the application of the die cushion load starts) (that is, the die cushion is controlled to wait in the standby position).

At 0.59 s (near a time point ($T_{Taiki}$=0.7 s)) while the cushion pad 128 is waiting, it is conformed whether or not the initial pressure $P_{k0}$ of the hydraulic cylinder group 151 stays within the range of the set target value (the initial pressure $P_{kL0}$) of 113.9±0.1 [kg/cm$^2$] in the initial pressure controller 188. Then, only when the confirmation is negative, an initial pressure control is performed so that the initial pressure $P_{k0}$ falls within the range of the target value. In this example, since the initial pressure $P_{k0}$ is 113.77 [kg/cm$^2$], the confirmation is negative (that is, the initial pressure control is performed).

When the initial pressure control is performed, the second solenoid valve 177 is turned ON at a time point of 0.6 s to close the second logic valve 173. Next, when the second logic valve 173 is closed completely at a time point of 0.65 s, the cushion pad 128 is controlled to wait (to be held) in the standby position only by the second servomotor 138.

At the same time, the torque command selector 189 selects a torque command output from the initial pressure controller 188 side. Then, the initial pressure controller 188 outputs a torque (open loop) command 190 corresponding (proportional) to around the initial pressure target value of 113.9 [kg/cm$^2$] (for example, 113.9±5 [kg/cm$^2$]) to the servo amplifier 183 via the torque command selector 189, and turns ON the first solenoid valve 175 to open the first logic valve 171. Here, the reason why the first logic valve 171 is opened in a state where the torque (open loop) command 190 is applied after the closure of the second logic valve 173, is to prevent the initial pressure $P_{k0}$ from dropping while the first logic valve 171 is being opened.

Next, when the first logic valve 171 is opened completely at a time point of 0.7 s, the initial pressure controller 188 outputs a torque (closed loop) command 190 to the servo amplifier 182 so that the initial pressure $P_{k0}$ of the hydraulic cylinder group 151 is controlled to have a command value of 114.0 [kg/cm$^2$] which is 0.1 [kg/cm$^2$] higher than the target value of 113.9 [kg/cm$^2$] based mainly on the target value of the initial pressure $P_{k0}$ of 113.9 [kg/cm$^2$] and the pressure signal 198 from the second pressure detector 140.

The initial pressure $P_{k0}$ is stabilized within the range of 114.0±0.02 [kg/cm$^2$] near a time point of 0.73 s. The first solenoid valve 175 is turned OFF and the first logic valve 171 is closed at a time point of 0.75 s. Following this, when the first logic valve 171 is closed completely at a time point of 0.8 s, the torque command selector 189 selects a torque command output from the die cushion controller 181 side. The cushion pad 128 is again position-controlled to wait in the standby position using the first servomotor 136 and the second servomotor 138.

At the same time, the second solenoid valve 177 is turned OFF, and the second logic valve 173 is opened. The second logic valve 173 is opened completely at a time point of 0.85 s, and the series of re-controlling operations of the initial pressure $P_{k0}$ and the sealing operation of the pressurized working fluid are completed. The initial pressure $P_{k0}$ is 113.932 [kg/cm$^2$]. When a poppet of a (poppet type) solenoid valve is switched (moved) while the second solenoid valve 177 is being turned OFF (to open the second logic valve 173), the initial pressure $P_{k0}$ drops by order of 0.1 [kg/cm$^2$] or smaller as a result of a minute amount of working fluid leaking from the hydraulic cylinder group 151 into the low pressure (system pressure) line. Thus, the command value of the initial pressure $P_{k0}$ is set 0.1 [kg/cm$^2$] greater than the target value to deal with the drop of the initial value $P_{k0}$. In this example (in the cushion pin pressure equalizing hydraulic circuit 170), since the initial pressure $P_{k0}$ is held at the pressure determined basically with no leakage, the re-controlling operation of the initial pressure $P_{k0}$ and the sealing operation of pressurized working fluid are performed once in several cycles to several tens of cycles.

<1.25 s to 2.15 s, Press Slide Descends to Bottom Dead Center, Die Cushion Load is Applied, and Pressing is Performed>

The predetermined (set) die cushion load, which is 2000 [kN] in this example, starts to be applied upward (in a direction in which the material 121 is pressed between the blank holder 124 and the upper die 120) by the action of the die cushion controller 181 at a time when the slide 110 comes into collision with the cushion pad 128 via the upper die 120 (at a time when the die cushion load starts to be applied), the material 121, the blank holder 124, the cushion pins **126*a* to 126*n*, the hydraulic cylinder group 151 and the like. Then, the application of the die cushion load completes in about 0.05 s. In association with (in proportion to) this, the pressure in the ascending-side pressurizing chambers of the hydraulic cylinder group 151** increases from the initial pressure $P_{k0}$ (113.93 [kg/cm$^2$]) to the pressure $P_{kD}$ (240.6 [kg/cm$^2$]) corresponding to the die cushion load (2000 [kN]). At this time (while the pressure is being increased), the variation in length of the cushion pins (of 30 cushion pins, 16 cushion pins have the predetermined length, 10 cushion pins are 1 mm longer than the predetermined length, and four cushion pins are 0.5 mm shorter than the predetermined length) is absorbed, whereby a uniform load of about 66.7 (=2000/30) [kN] is applied to all the cushion pins.

A drawing advances while a predetermined uniform die cushion load component force for each of the cushion pins is being applied to the material 121 held between the blank holder 124 and the upper die 120 without generating drawing wrinkles or failure in each part on the material 121.

The drawing completes near the bottom dead center of the pressing process (in a position about 1 mm or less above the bottom dead center), and the die cushion load (the pressure corresponding to the die cushion load) is relieved by the action of the die cushion controller 181. In association with (in proportion to) this, the pressure of the hydraulic cylinder group 151 also drops from the pressure $P_{kD}$ (240.6 [kg/cm$^2$]) corresponding to the die cushion load to the initial pressure $P_{k0}$ (113.92 [kg/cm$^2$]). Since the initial pressure $P_{k0}$ almost never changes (decreases), the initial pressure $P_{k0}$ is not re-controlled, and the sealing operation of the working fluid is not performed (no re-controlling and sealing operations are necessary) when the die cushion waits in the standby position for the next cycle.

<2.15 s to 4.3 s, Press Slide Ascends to Top Dead Center, Product is Knocked Out, and Cushion Pad Waits in Standby Position>

The slide 110 ascends from the bottom dead center to the top dead center. The die cushion (the cushion pad 128) is switched from the die cushion pressure control to the die cushion position control by the die cushion controller 181 at a time when the die cushion load (the pressure corresponding to the die cushion load) is relieved almost completely. The die cushion moves continuously from a position near the bottom dead center of the pressing process toward the die cushion standby position while knocking out a product, according to a die cushion position command that is generated automatically based on a knocking out set value (a set value of a retention time period in a position near the bottom dead center or a set value of ascending speed) and continuously changes. Then the die cushion reaches the standby position.

Incidentally, in the case where an error occurs in the set initial pressure ($P_{kL0}$), for example, when the initial pressure ($P_{kL0}$) becomes greater than the target initial pressure command value ($P_{kL0}$Ref), the contraction amount of the hydraulic cylinder group 151 decreases accordingly. This causes a concern that the pressure equalizing effect becomes weaker than the desired effect. On the other hand, when the initial pressure ($P_{kL0}$) becomes smaller than the initial pressure command value ($P_{kL0}$Ref), the contraction amount of the hydraulic cylinder group 151 increases accordingly. This causes a concern that the response to application of the die cushion load deteriorates.

Both when the initial pressure ($P_{kL0}$) becomes greater and smaller than the initial pressure command value ($P_{kL0}$Ref), the contraction amount of the hydraulic cylinder group 151 changes, causing a concern that the response of the die cushion load deteriorates.

Consequently, it is realistically very important to control and generate accurately the initial pressure ($P_{kL0}$) according to the initial pressure command value ($P_{kL0}$Ref). Hereinafter, this will be described in detail.

Figure 5:
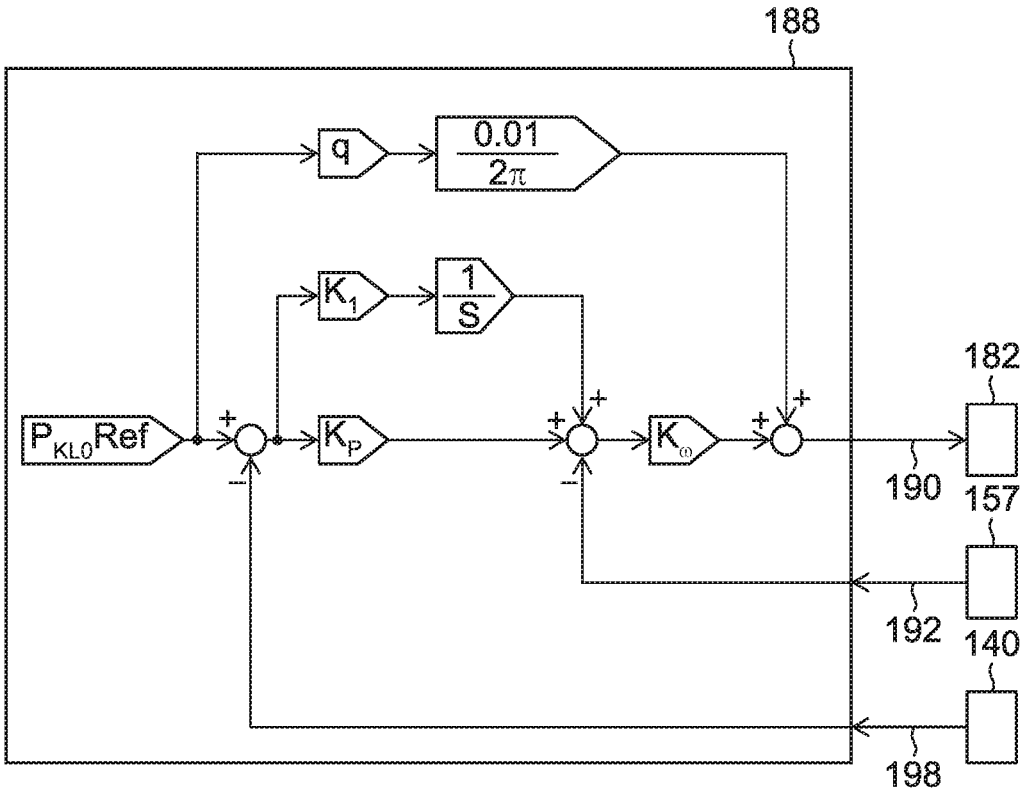
FIG. 5 is a block diagram illustrating in detail an initial pressure controller 188 illustrated in FIG. 3.

FIG. 5 is a block diagram illustrating in detail the initial pressure controller 188 illustrated in FIG. 3.

Reference signs and reference numerals in FIG. 5 will be as below.

190: Torque command [kgm] of the first servomotor 136;

192: Servomotor angular velocity signal ω [rad/s];

198: Pressure signal $P_k$ from the second pressure detector 140 [kg/cm$^2$];

$P_{kLo}$Ref: Initial pressure command [kg/cm$^2$];

q: Displacement volume of the first hydraulic pump/motor 135 [cm$^3$/rev];

$K_p$: Proportional compensation constant;

$K_I$: Integrated compensation constant;

1/S: Integration; and

Kω: Angular velocity compensation constant.

In FIG. 5, the initial pressure controller 188 performs a control based on the initial pressure command value ($P_{kL0}$Ref), the pressure ($P_k$) of the cushion pin pressure equalizing hydraulic cylinder group 151, and the servomotor angular velocity signal (ω) of the first servomotor 136. Specifically, a feedforward (open) compensation component is proportional to the initial pressure command value ($P_{kL0}$Ref). A feedback (closed) compensation component is proportional to a result obtained by deducting the servomotor angular velocity signal ω from a sum (Proportional-Integral compensation) of a component that is proportional to a deviation between the initial pressure command value ($P_{kL0}$Ref) and the current pressure ($P_k$) (an output of a proportional compensator having the proportional compensation constant $K_p$), and a component that is proportional to an integration of the deviation (an output of an integration compensator having the integrated compensation constant $K_I$). The initial pressure controller 188 outputs the sum of the feedforward (open) compensation component and the feedback (closed) compensation component to the servo amplifier 182 as the torque command 190, whereby the first servomotor 136 is driven.

The feedforward compensation component is a basic torque component that is physically proportional to the initial pressure command ($P_{kL0}$Ref) and plays a role of reasonably generating $P_{kL0}$Ref. The feedback compensation component plays a role of causing the initial pressure ($P_{kL0}$) to respond to the initial pressure command value ($P_{kL0}$Ref) quickly (mainly by the action of $K_p$), accurately (mainly by the action of $K_I$), and stably (mainly by the action of Kω in control.

Figure 6:
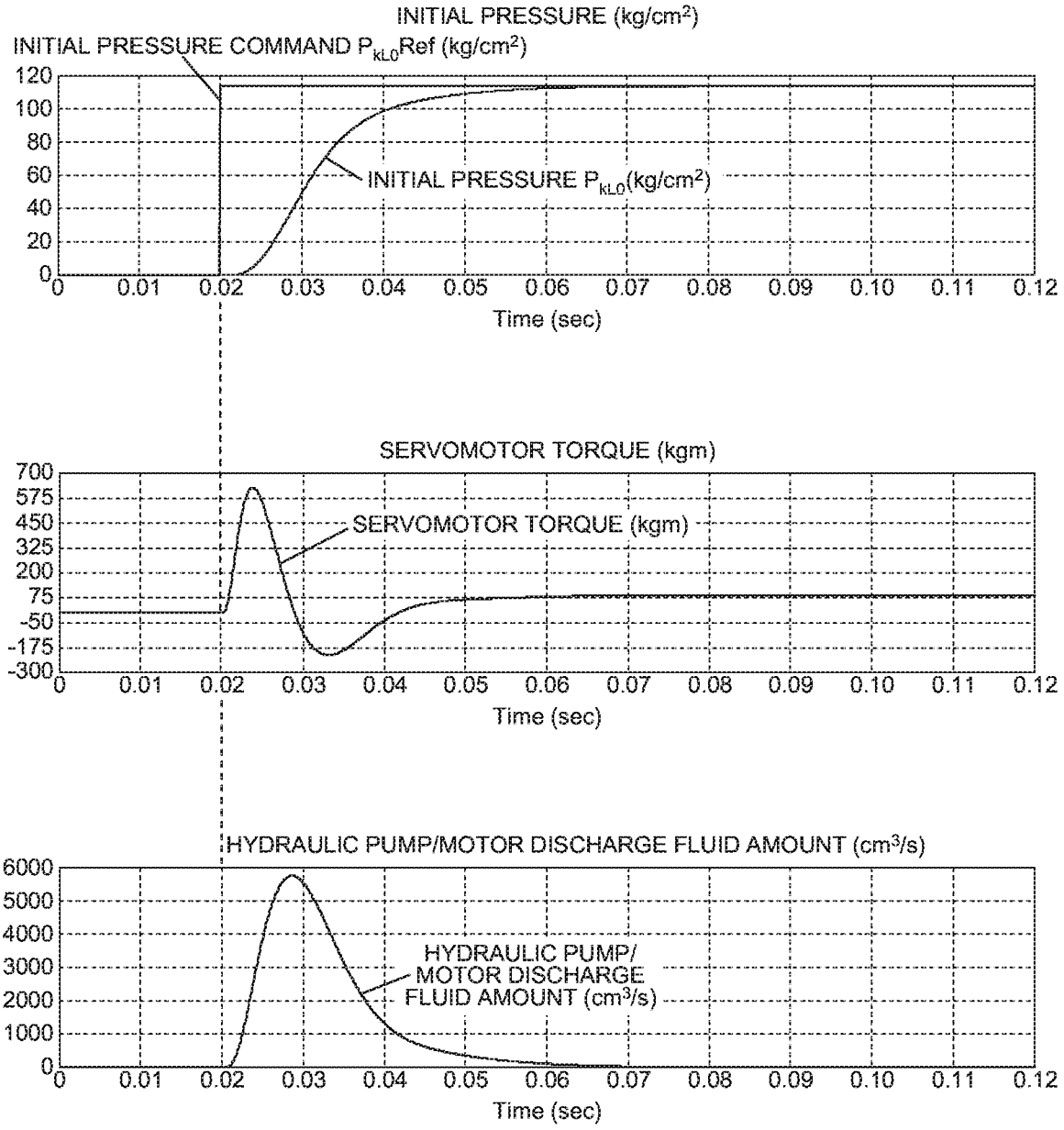
FIG. 6 shows a time response waveform of an initial pressure ($P_{kLo}$) and the like when the initial pressure ($P_{kLo}$) is controlled based on the block diagram of the initial pressure controller 188 shown in FIG. 5.

FIG. 6 shows a time response waveform of an initial pressure ($P_{kLo}$) and the like when the initial pressure ($P_{kLo}$) is controlled based on the block diagram of the initial pressure controller 188 illustrated in FIG. 5. In FIG. 6, the chart in the upper stage shows the initial pressure command ($P_{kL0}$Ref) and the initial pressure ($P_{kL0}$) indicating time response to the initial pressure command. The chart in the middle stage in FIG. 6 shows the servomotor torque of the first servomotor 136. The chart in the bottom stage in FIG. 6 shows a discharge amount of working fluid of the first hydraulic pump/motor 135.

In this example, it is assumed that the torque responsiveness (angular frequency) of the first servomotor 136 that is used is 600 [rad/s] after primary approximation, the inertia moment of the first servomotor 136 and the first hydraulic pump/motor 135 that is shaft connected thereto is 0.4 [kgm$^2$], and the displacement volume (q) of the first hydraulic pump/motor 135 is 500 [cm$^3$/rev]. In this case, as shown in the first chart in FIG. 6, the initial pressure $P_{kL0}$ responds to the initial pressure command $P_{kL0}$Ref (113.9 [kg/cm$^2$]) within 0.1 s with an accuracy in the range of ±0.02 [kg/cm$^2$] by controlling appropriately the control parameters (constants) $K_p$, $K_I$, Kω.

Thus, the method of controlling the pressure by driving the first hydraulic pump/motor 135 that is shaft connected to the first servomotor 136 is suitable for controlling the pressure of the hydraulic cylinder group 151 that is detected by the second pressure detector 140 to the target value (in the range of ±0.1 [kg/cm$^2$] of the target value at worst).

In the case where the plurality of cushion pins are produced with good accuracy, and hence, there is no need to absorb the variation in length of the cushion pins, the necessary minimum average contraction amount ($\Delta L_k$) is unnecessary. The initial pressure can be set to the pressure corresponding to the die cushion load (the greatest die cushion load or greater in the set target die cushion loads) from the beginning, and in this case, the response delay time of the die cushion load due to the interposition of the hydraulic cylinder group 151 is almost eliminated.

<Operation of Die Cushion Device with Cushion Pin Pressure Equalizing Function (when Die Cushion Load Changes in Pressing Process)>

One of characteristics of the invention, that is, the effectiveness when a special material is used will be described.

Figure 7:
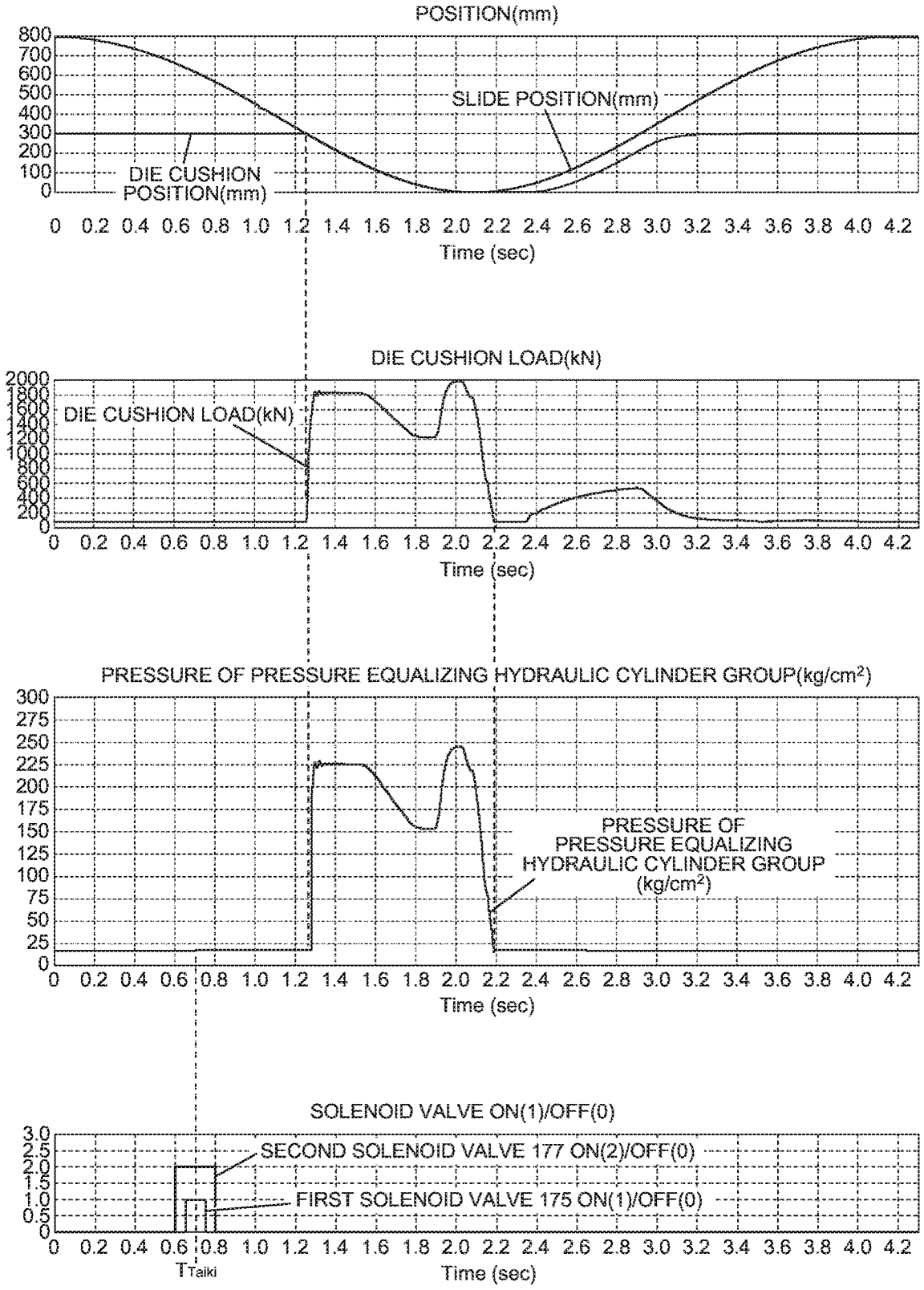
FIG. 7 shows other waveforms of main physical quantities in one cycle (during a continuous operation) in the die cushion device with a cushion pin pressure equalizing function according to the first embodiment shown in FIG. 1.

FIG. 7 shows other waveforms of main physical quantities in one cycle (during a continuous operation) in the die cushion device with a cushion pin pressure equalizing function according to the first embodiment shown in FIG. 1. More particularly, FIG. 7 shows waveforms of main physical quantities when the die cushion load can be uniformly applied to the material while changing the die cushion load according to the properties of the material or the specific forming performance of the die during the pressing process in order to improve the forming performance for a special material or a low-workability material difficult which are expected in future.

As in FIG. 4, the chart in the uppermost stage in FIG. 7 shows a position of the press slide and a position of the die cushion, the chart in the second-highest stage in FIG. 7 shows the die cushion load, the chart in the third-highest stage in FIG. 7 shows the pressure of the cushion pin pressure equalizing hydraulic cylinder group 151 in which the ascending-side pressurizing chambers communicate with each other, and the chart in the bottom stage in FIG. 7 shows ON/OFF states of the first solenoid valve 175 and the second solenoid valve 177. The waveforms shown in FIG. 7 are different from the waveforms shown in FIG. 4 particularly in that the die cushion load changes during the pressing process as shown in the chart in the second-highest stage, and that the pressure of the cushion pin pressure equalizing hydraulic cylinder group 151 also changes as the die cushion load changes as shown in the chart in the third-highest stage.

As shown in the chart in the second-highest stage of FIG. 7, the value of the target die cushion load that is set by the die cushion load setting unit 181*a* becomes constant at 1800 [kN] while the die cushion position is from 300 mm to 160 mm after the start of the die cushion load application (at 300 mm), Then, the die cushion load changes (drops) to 1200 [kN] continuously (in a tapered fashion, or gradually) while the die cushion position changes from 160 mm to 60 mm. Then, the die cushion load changes (increases) to 2000 [kN] when the die cushion position approaches near the bottom dead center.

The first dropping of the die cushion load is intended to suppress failure of the material, and the last increase of the die cushion load is intended to ensure the precision of a product.

The necessary average contraction amount $\Delta L_k$ of the cushion pin pressure equalizing hydraulic cylinder group 151 is 1 mm. The initial pressure $P_{K0}$ of the hydraulic cylinder group 151 (that is calculated in advance in the initial pressure controller 188 and is then set in the initial pressure setting unit 188*a*) based on the necessary average contraction amount $\Delta L_k$ of 1 mm is 17.7 [kg/cm$^2$] that is based on the lowest die cushion load value of 1200 [kN] in the die cushion load values shown in the chart in the second-highest stage of FIG. 7.

The initial pressure becomes smaller relative to the constant average contraction amount $\Delta L_k$, as the die cushion load becomes smaller. Thus, the response time to the application of the die cushion load is extended accordingly by a necessary least amount.

In this way, irrespective of the change in die cushion load during the pressing process, which is becoming popular recently, it is possible to control the initial pressure $P_{kL0}$ so as to correspond to the necessary minimum average contraction amount $\Delta L_k$. This is one of the characteristics of the invention.

<Second Embodiment of Die Cushion Device with Cushion Pin Pressure Equalizing Function>

Figure 8:
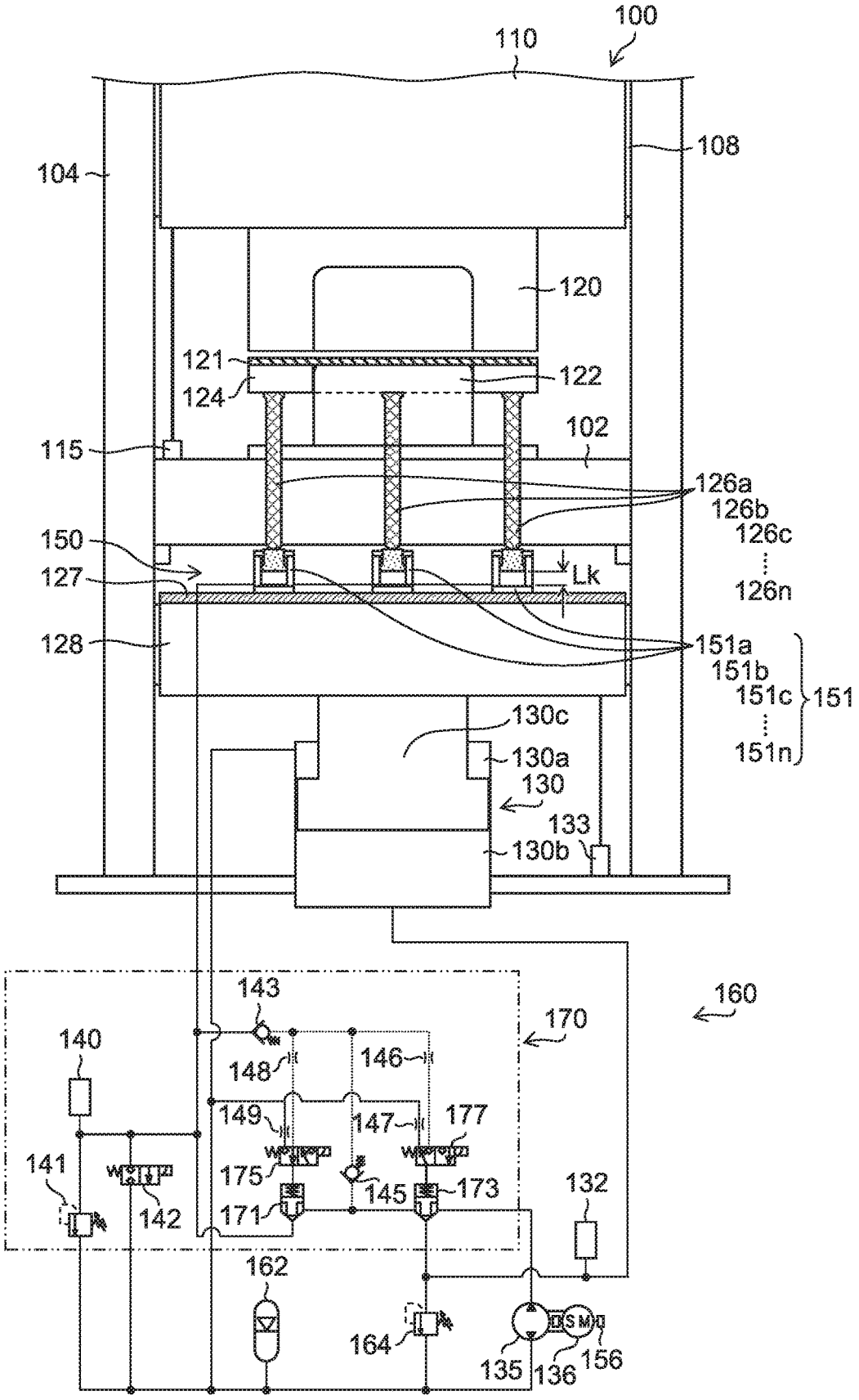
FIG. 8 is a main block diagram illustrating a press system including a die cushion device with a cushion pin pressure equalizing function according to a second embodiment of the present invention.

FIG. 8 is a main block diagram illustrating a press system including a die cushion device with a cushion pin pressure equalizing function according to a second embodiment of the present invention. In FIG. 8, like reference numerals will be given to common portions with the die cushion device with a cushion pin pressure equalizing function according to the first embodiment illustrated in FIG. 1, and the description thereof will be omitted here.

The die cushion device with a cushion pin pressure equalizing function according to the second embodiment illustrated in FIG. 8 differs from that of the first embodiment illustrated in FIG. 1 in the configuration of the die cushion device 160. That is, in the die cushion device 160 according to the second embodiment, the first hydraulic device for the die cushion and the second hydraulic device for cushion pin pressure equalization include the first servomotor 136 and the first hydraulic pump/motor 135 shaft connected to the first servomotor 136 which are commonly used or shared by both the first and second hydraulic devices. The die cushion device 160 according to the second embodiment does not include the second servomotor 138 and the second hydraulic pump/motor 137 shaft connected to the second servomotor 138 which are used exclusively to drive a die cushion hydraulic cylinder 130 in the die cushion device 160 according to the first embodiment.

The first servomotor 136 and the first hydraulic pump/motor 135 shaft connected the first servomotor 136 are used to generate the initial pressure for the cushion pin pressure equalizing hydraulic cylinder group 151 near a time point (a time point $T_{Taiki}$) while a cushion pad 128 is waiting in the standby position (a slide position when the die cushion load control starts) in one operation cycle of the press machine. Otherwise, the first servomotor 136 and the first hydraulic pump/motor 135 are used to drive the die cushion hydraulic cylinder 130.

The cushion pad 128 is not driven by the first servomotor 136 near the time point $T_{Taiki}$ when the cushion pad 128 is waiting in the standby position. However, the cushion pad 128 is held in the standby position by holding the pressure which is applied to (the ascending-side pressurizing chamber 130*b* of) the hydraulic cylinder 130 to keep the cushion pad 128 in the standby position, with no leakage (with a seating action of a poppet portion of the second logic valve 173) by closing the second logic valve 173.

A time period during which the initial pressure of the cushion pin pressure equalizing hydraulic cylinder group 151 is controlled is a slight time period near the time point $T_{Taiki}$ when the cushion pad 128 is waiting in the standby position, and after this time period has elapsed, the die cushion position controlling mode is restored. Consequently, even though the die cushion position controlling mode is switched to a non-controlling mode during the time period when the initial pressure of the hydraulic cylinder group 151 is controlled, since the die cushion position controlling mode is restored thereafter, the cushion pad 128 can be held in the standby position accurately.

<Second Embodiment of Control Device>

Figure 9:
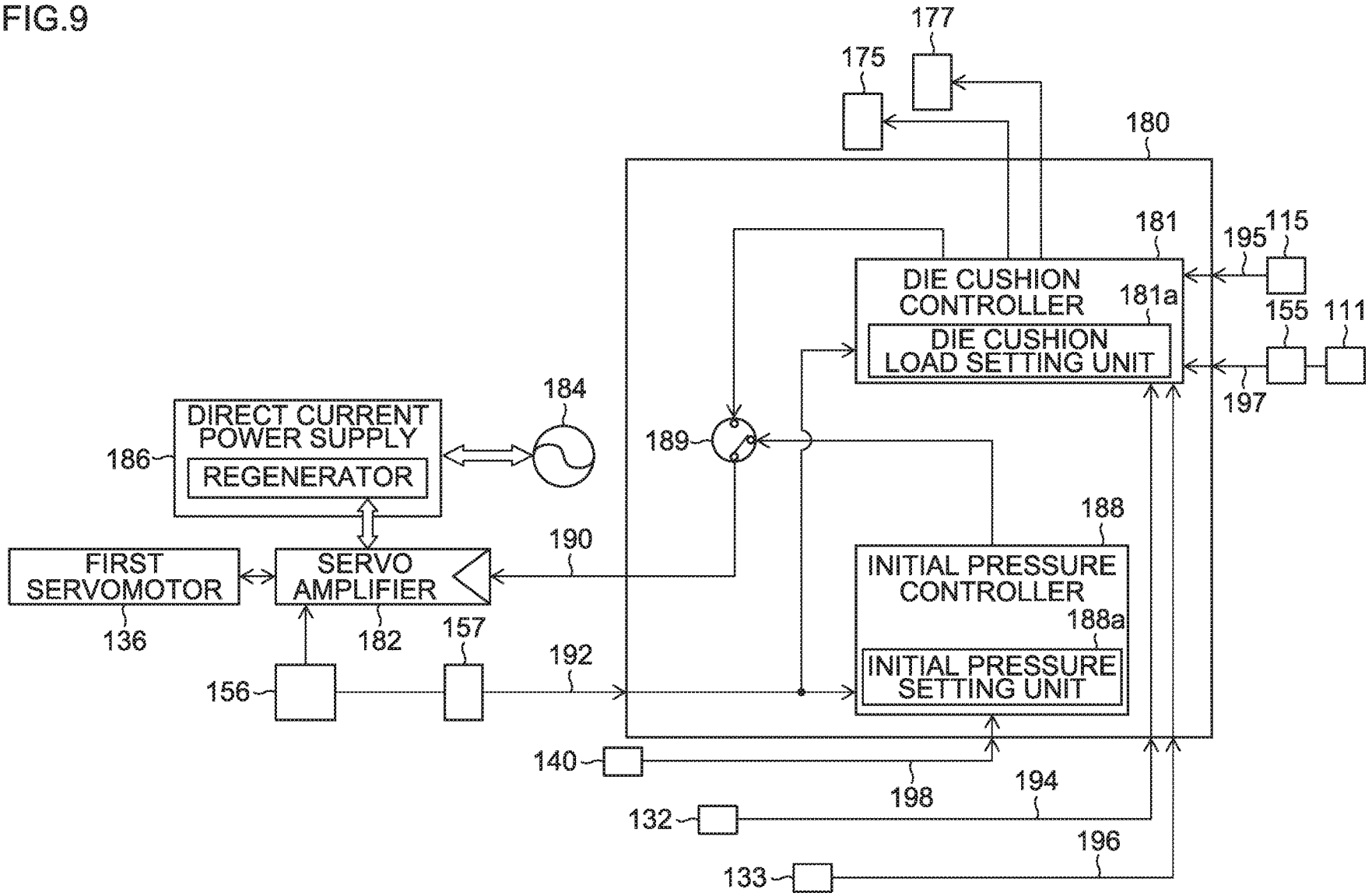
FIG. 9 is a block diagram mainly illustrating a second embodiment of a control device that is applied to the die cushion device with a cushion pin pressure equalizing function according to the second embodiment illustrated in FIG. 8.

FIG. 9 is a block diagram mainly illustrating a second embodiment of a control device that is applied to the die cushion device with a cushion pin pressure equalizing function according to the second embodiment illustrated in FIG. 8. In FIG. 9, like reference numerals will be given to common portions with the control device according to the first embodiment that is applied to the die cushion device with a cushion pin pressure equalizing function according to the first embodiment illustrated in FIG. 3, and the description thereof will be omitted here.

The control device 180 illustrated in FIG. 9 differs from the control device 180 illustrated in FIG. 3 in that the control device 180 controls only the first servomotor 136. That is, the die cushion controller 181 illustrated in FIG. 9 uses only the first servomotor 136 to control the die cushion position and the die cushion pressure (die cushion load) via the first hydraulic pump/motor 135, in the die cushion position controlling mode or the die cushion pressure controlling mode.

An initial pressure controller 188 illustrated in FIG. 9 controls only the first servomotor 136 to control the initial pressure of the cushion pin pressure equalizing hydraulic cylinder group 151, and therefore, the initial pressure controller 188 illustrated in FIG. 9 is similar to the initial pressure controller 188 illustrated in FIG. 3.

<Third Embodiment of Die Cushion Device with Cushion Pin Pressure Equalizing Function>

Figure 10:
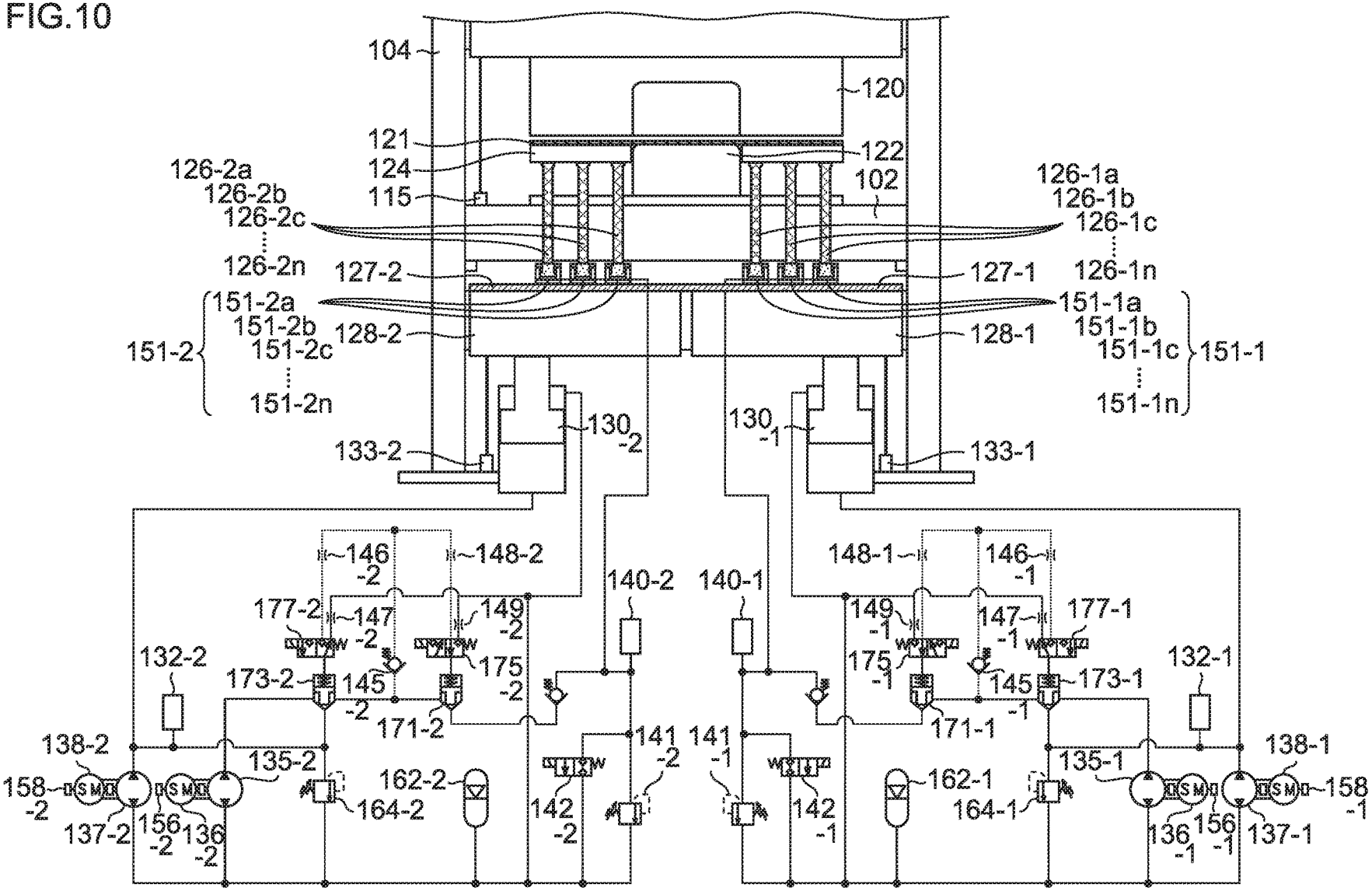
FIG. 10 is a main block diagram illustrating a press system including a die cushion device with a cushion pin pressure equalizing function according to a third embodiment of the present invention.

FIG. 10 is a main block diagram illustrating a press system including a die cushion device with a cushion pin pressure equalizing function according to a third embodiment of the present invention. In FIG. 10, like reference numerals, although suffix numbers are added, will be given to common portions with the die cushion device with a cushion pin pressure equalizing function according to the first embodiment illustrated in FIG. 1, and the description thereof will be omitted here.

The die cushion device with a cushion pin pressure equalizing function according to the third embodiment illustrated in FIG. 10 differs from that of the first embodiment in that the die cushion device according to the third embodiment includes a plurality of (two) the die cushion devices with a cushion pin pressure equalizing function according to the first embodiment illustrated in FIG. 1.

That is, in FIG. 10, cushion pins 126-1*a* to 126-1*n* and cushion pins 126-2*a* to 126-2*n* are disposed in a left-right direction, and similarly, a cushion pin pressure equalizing hydraulic cylinder group 151-1 (hydraulic cylinders 151-1*a* to 151-1*n*) and a cushion pin pressure equalizing hydraulic cylinder group 151-2 (hydraulic cylinders 151-2*a* to 151-2*n*) are disposed in the left-right direction.

The cushion pad is divided to cushion pads 128-1, 128-2 at a center in the left-right direction. In FIG. 10, the hydraulic cylinder group 151-1 is arrayed on (a pin plate 127-1 of) the right cushion pad 128-1, and the hydraulic cylinder group 151-2 is arrayed on (a pin plate 127-2 of) the left cushion pad 128-2.

Die cushion hydraulic cylinders 130-1, 130-2 support the cushion pads 128-1, 128-2, respectively, and generate die cushion loads independently for the cushion pads 128-1, 128-2.

Two first hydraulic devices for respectively driving the die cushion hydraulic cylinders 130-1, 130-2, two second hydraulic devices for respectively setting initial pressures for the cushion pin pressure equalizing hydraulic cylinder groups 151-1, 151-2, and two sets of various types of detectors, are provided on the left and right.

With the above configuration of the die cushion device with a cushion pin pressure equalizing function according to the third embodiment, a necessary die cushion load can be applied to each of the cushion pads 128-1, 128-2. Accordingly, the cushion pin pressure equalizing hydraulic cylinder groups 151-1, 151-2 are respectively in communication with the cushion pads 128-1, 128-2 so that initial pressures of the hydraulic cylinder groups 151-1, 151-2 can be independently applied to the cushion pads 128-1, 128-2.

By adopting this configuration, in pressing the material for a product different in shape (in the left and light), a uniform die cushion load can be easily applied to necessary parts of the die, thereby making it possible to improve the quality of the formed product.

In this example, the cushion pad is divided into the cushion pads 128-1, 128-2 at the center so as to be independent of each other transversely; however, the left and right cushion pads may be integrated with each other. Even with the left and right integrated cushion pads, the other configurations remain as illustrated in the third embodiment in FIG. 10, and a necessary die cushion load is desirably applied to each of the two die cushion hydraulic cylinders on the left and right 130-1, 130-2, so that a necessary initial pressure is desirably applied to each of the cushion pin pressure equalizing hydraulic cylinder groups 151-1, 151-2. Even when the cushion pads are integrated with each other, the cushion pads are elastically deformed according to die cushion loads applied to the left and right cushion pads so as to apply the die cushion loads accordingly to the die, whereby necessary die cushion loads can also be applied easily to necessary parts on (the left and right sides of) the die. Therefore, the material can easily be pressed to obtain a product shaped differently (in the left and light) with good quality.

In the third embodiment illustrated in FIG. 10, explanation is made for an example in which the die cushion load is controlled for each of the left and right cushion pads 128-1, 128-2, or for each of the die cushion hydraulic cylinder 130-1, 130-2 and the initial pressure is controlled for each of the cushion pin pressure equalizing hydraulic cylinder groups 151-1, 151-2. However, the invention is not limited to the configuration so described. Hence, a configuration may be adopted in which a die cushion load can be controlled for each of four cushion pads that are divided transversely (left and light) and longitudinally (rear and front) or for each of four die cushion hydraulic cylinder, and an initial pressure can be controlled for each of the four die cushion pin pressure equalizing hydraulic cylinder groups. In this case, a necessary die cushion load can easily be applied to each of necessary parts of the die uniformly in pressing a material to form a product shaped differently transversely and longitudinally, whereby the quality of the shaped product can be improved.

<Third Embodiment of Control Device>

Figure 11:
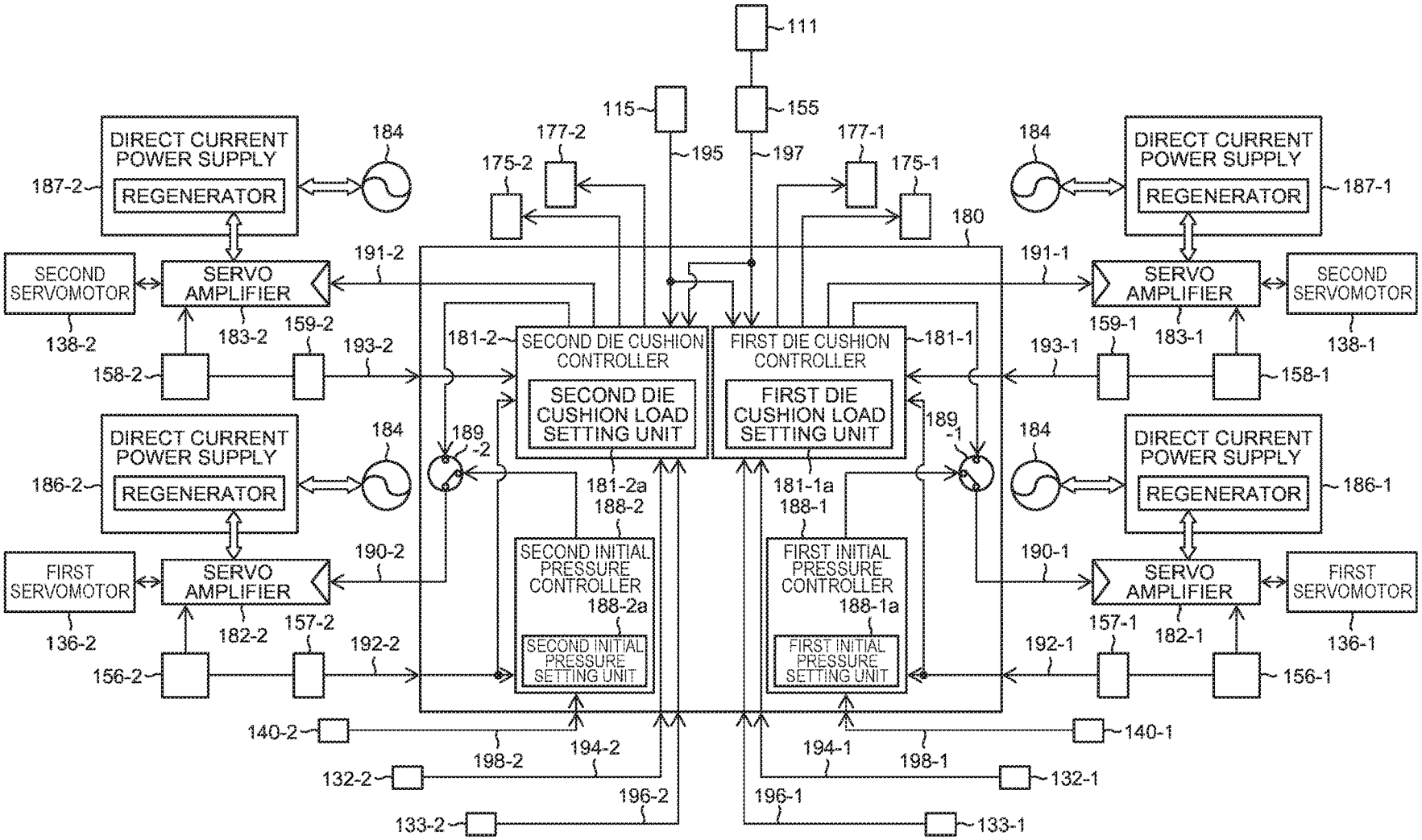
FIG. 11 is a block diagram mainly illustrating a third embodiment of a control device that is applied to the die cushion device with a cushion pin pressure equalizing function according to the third embodiment illustrated in FIG. 10.

FIG. 11 is a block diagram mainly illustrating a third embodiment of a control device that is applied to the die cushion device with a cushion pin pressure equalizing function according to the third embodiment illustrated in FIG. 10. In FIG. 11, like reference numerals, although suffix numbers are added, will be given to common portions with the control device according to the first embodiment that is applied to the die cushion device with a cushion pin pressure equalizing function according to the first embodiment illustrated in FIG. 3, and the description thereof will be omitted here.

A control device 180 illustrated in FIG. 11 includes a first die cushion controller 181-1, a first initial pressure controller 188-1, a second die cushion controller 181-2, and a second initial pressure controller 188-2 which control independently and individually two sets of a first servomotor 136-1 and a second servomotor 138-1, and a first servomotor 136-2 and a second servomotor 138-2.

A first die cushion load setting unit 181-1*a* and a second die cushion load setting unit 181-2*a* can set a target die cushion load independently and individually, and the first die cushion controller 181-1 and the second die cushion controller 181-2 can independently and individually control the die cushion loads that are applied to the cushion pads 128-1, 128-2 which are separated at a center. By adopting this configuration, in pressing the material to form a product shaped differently, a necessary die cushion load can be applied to each of necessary parts of the die, thereby making it possible to improve the quality of the formed product.

The first initial pressure setting unit 188-1*a* and the second initial pressure setting unit 188-2*a* can set independently and individually initial pressure target values according to target die cushion loads (respective lowest die cushion loads of target die cushion loads) that are set independently. The first initial pressure setting unit 188-1*a* and the second initial pressure setting unit 188-2*a* can control independently the initial pressures of the cushion pin pressure equalizing hydraulic cylinder groups 151-1, 151-2 according to the set initial pressure target values.

<Fourth Embodiment of Die Cushion Device with Cushion Pin Pressure Equalizing Function>

Figure 12:
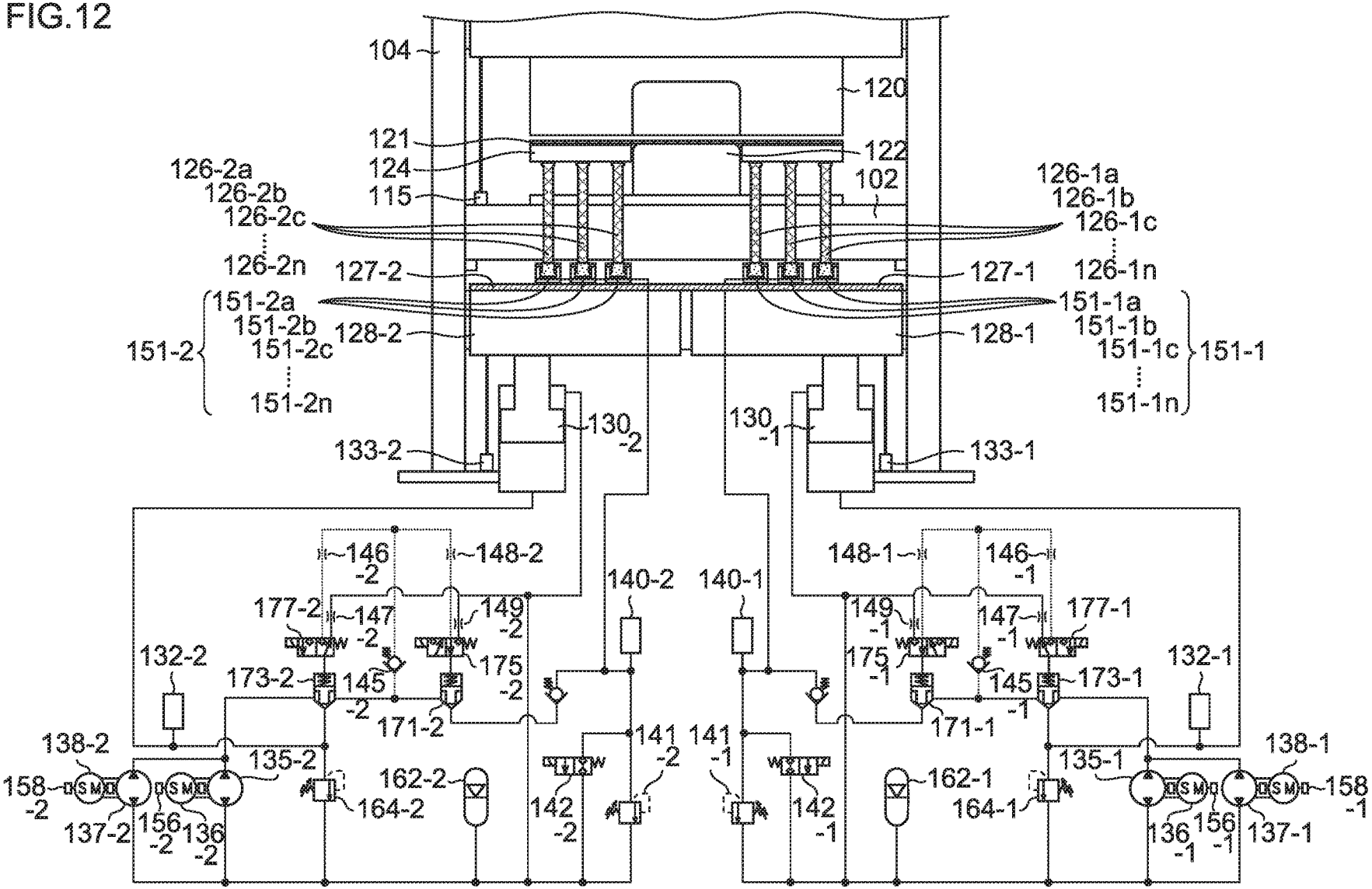
FIG. 12 is a main block diagram illustrating a press system including a die cushion device with a cushion pin pressure equalizing function according to a fourth embodiment of the present invention.

FIG. 12 is a main block diagram illustrating a press system including a die cushion device with a cushion pin pressure equalizing function of a fourth embodiment of the present invention. In FIG. 12, like reference numerals will be given to common portions with the die cushion device with a cushion pin pressure equalizing function according to the third embodiment illustrated in FIG. 10, and the description thereof will be omitted here.

The die cushion device with a cushion pin pressure equalizing function of the fourth embodiment illustrated in FIG. 12 differs from that of the third embodiment. That is, unlike the third embodiment, the die cushion device according to the fourth embodiment includes: hydraulic pumps/motors 135-1, 137-1 and 135-2, 137-2 that are provided in left and right as first hydraulic pumps/motors; and servomotors 136-1, 138-1 that are respectively shaft connected to rotational shafts of the hydraulic pumps/motors 135-1, 137-1, and servomotors 136-2, 138-2 that are respectively shaft connected to rotational shafts of the hydraulic pumps/motors 135-2, 137-2, are provided in left and right as first servomotors. Moreover, unlike the third embodiment, the die cushion device according to the fourth embodiment does not include second servomotors for driving exclusively die cushion hydraulic cylinders 130-1, 130-2.

The die cushion device with a cushion pin pressure equalizing function according to the fourth embodiment is similar to the die cushion device with a cushion pin pressure equalizing function according to the second embodiment illustrated in FIG. 8 in that no second servomotors for driving exclusively the die cushion hydraulic cylinders 130-1, 130-2 are provided.

Consequently, in a control device of the die cushion device with a cushion pin pressure equalizing function of the fourth embodiment, the same control is performed as the control performed by the control device according to the second embodiment illustrated in FIG. 9. That is, the right pair of servomotors 136-1, 138-1 and the left pair of servomotors 136-2, 138-2 are used to generate initial pressures for the cushion pin pressure equalizing devices near a time point (a time point $T_{Taiki}$) while cushion pads 128-1, 128-2 are waiting in standby positions (a slide position where a die cushion load control starts) in one operation cycle of the press machine. Otherwise, the right pair of servomotors 136-1, 138-1 and the left pair of servomotors 136-2, 138-2 are used to drive the die cushions.

The reason why the right pair of servomotors 136-1, 138-1 and the left pair of servomotors 136-2, 138-2 are provided for left and right respectively is to apply the die cushion loads to the cushion pads 128-1, 128-2 under a condition where a press slide descends at higher speeds. The reason why the two servomotors are used (also) when the initial pressures are generated for the cushion pin pressure equalizing devices is mainly to simplify the controller (control calculation) by not performing simultaneously different controls (control of die cushion position and control of initial pressure of cushion pin pressure equalizing hydraulic cylinder group).

The reason why the necessary die cushion loads can be applied individually to the cushion pads 128-1, 128-2 that are separated at the center and the initial pressures can be applied individually to the cushion pin pressure equalizing hydraulic cylinder groups 151-1, 151-2 is to easily apply the necessary die cushion load to each of necessary parts on the die in a uniform manner and improve the quality of a formed product, in press forming the product shaped differently (in left and right), as with the third embodiment illustrated in FIG. 10.

Comparison Example (1) The overall system can be configured inexpensively.

Patent Literature 1 describes the embodiment in which the conventional cushion pin pressure equalizing device is applied to the pneumatic die cushion device.

The cushion pin pressure equalizing device described in Patent Literature 1 needs the hydraulic device (the initial pressure generating device) for supplying the working fluid to the cushion pin pressure equalizing hydraulic cylinder group, separately from the pressurized air supply source for the pneumatic die cushion device.

In contrast with this conventional pneumatic die cushion device, in the die cushion device with a cushion pin pressure equalizing function according to the first to fourth embodiments of the present invention, the first servomotor 136 and the first hydraulic pump/motor 135 shaft connected thereto can be used commonly or shared by the first hydraulic device for die cushion and the second hydraulic device for cushion pin pressure equalization. According to the present embodiments, there is no need to newly add the hydraulic device (in particular, the basic elements of the first servomotor 136 and the first hydraulic pump/motor 135 shaft connected thereto) for supplying the working fluid to the cushion pin pressure equalizing hydraulic cylinder.

That is, the cushion pin pressure equalizing device applied to the conventional pneumatic die cushion device needs the hydraulic device (equipped with the motor and the hydraulic pump) for exclusive use for the cushion pin pressure equalizing device which supplies the working fluid to the cushion pin pressure equalizing hydraulic cylinder group and the control device for controlling the initial pressure (together with the initial pressure generating device). However, in the die cushion device with a cushion pin pressure equalizing function according to the first to fourth embodiments of the invention, the hydraulic device of the servo die cushion device can double as the initial pressure generating device, and hence, exclusive hydraulic device becomes unnecessary, whereby the overall system can be configured with low cost.

(2) The cushion pin pressure equalizing hydraulic cylinder group (piston seals or the like) is easy to be maintained.

In the conventional pneumatic die cushion device described in Patent Literature 1, a surge (impact) is generated easily in the die cushion load when the die cushion load starts to be applied.

Figure 13:
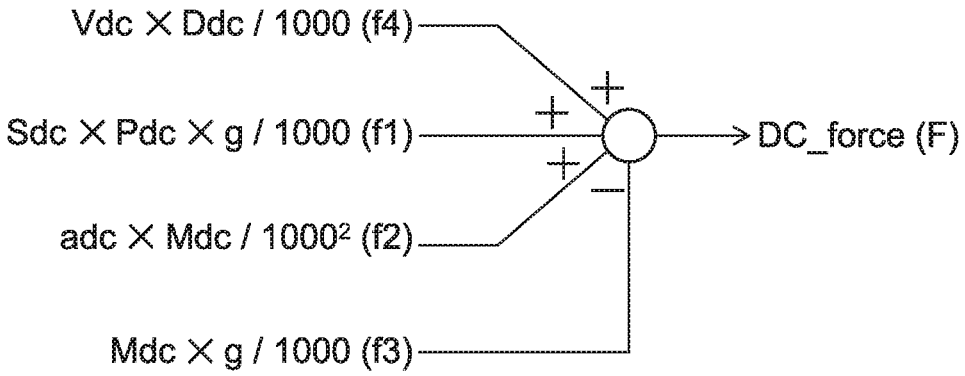
FIG. 13 is a block diagram illustrating components of a die cushion load.

FIG. 13 is a block diagram illustrating components of a die cushion load. Reference signs shown in FIG. 13 are as follows.

Vdc: Cushion pad speed (mm/s);
Ddc: Viscosity resistance coefficient=196 (kN·s/m);
Sdc: Total cylinder sectional area ($cm^2$);
Sdc_a=40791.35: Pneumatic die cushion
Sdc_s=815.83: Servo die cushion
Pdc: Pressure in die cushion cylinder ($kg/cm^2$);
(rate value when 2000 kN is applied)
Pdc_a=5.0: Pneumatic die cushion
Pdc_s=250.0: Servo die cushion
g: Gravitational acceleration=9.806 ($m/s^2$);
$a_{dc}$: Cushion pad acceleration ($m/s^2$);
Mdc: Cushion pad interlocked mass=12900 (kg);
f1: Cylinder thrust (kN);

$$f1=Sdc\times Pdc\times g/1000$$

f2: Acceleration reaction force of cushion pad (kN);

$$f2=-a_{dc}\times Mdc/1000^2(\text{kN});$$

f3: Gravity of cushion pad interlocked portion (kN);

$$f3=Mdc\times g/1000(\text{kN});$$

f4: Viscosity resistance force of cushion pad (kN);

$$f4=-Vdc\times Ddc/1000(\text{kN});\ \text{and}$$

F: DC_force: Die cushion load (kN);

$$F=f1+f2-f3+f4.$$

Where, in relation to the speed and acceleration of the cushion pad, upward speed and acceleration designate positive speed and acceleration.

Figure 14:
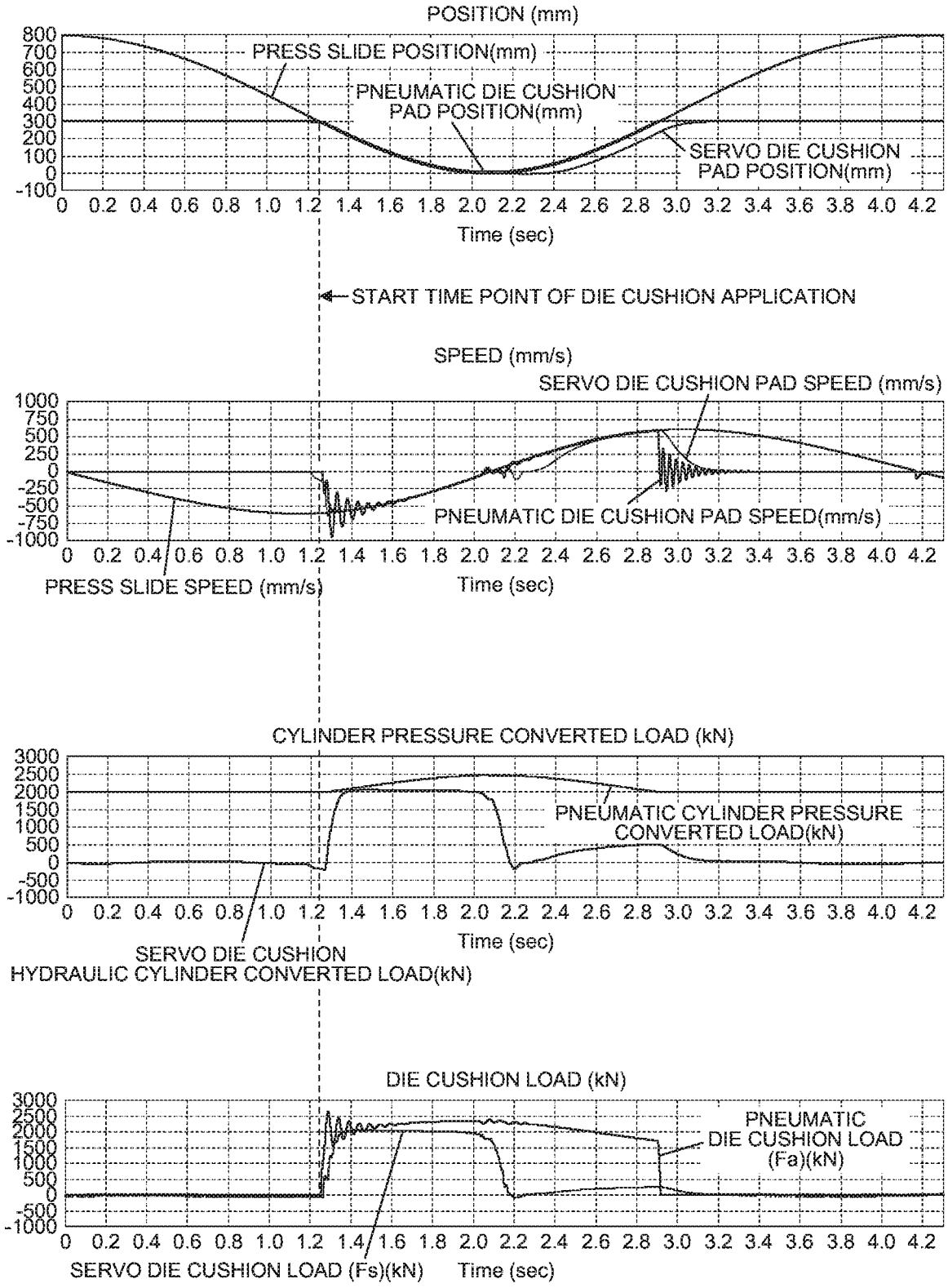
FIG. 14 shows waveforms of main physical quantities in one cycle (during a continuous operation) in a pneumatic die cushion device and a servo die cushion device.

FIG. 14 shows waveforms of main physical quantities in one cycle (during a continuous operation) in a pneumatic die cushion device and a servo die cushion device. FIG. 14 shows the result when the die cushion load of about 2000 [kN] is applied to the conventional pneumatic die cushion device described in Patent Literature 1 and the result when the die cushion device with a cushion pin pressure equalizing function according to the first to fourth embodiments of the invention (that is, the servo die cushion device in which a die cushion load is generated via the hydraulic pump/motor shaft connected to the servomotor and the hydraulic cylinder).

The chart in the uppermost stage in FIG. 14 shows a press slide position, a pneumatic die cushion (pad) position, and a servo die cushion (pad) position.

The chart in the second-highest stage in FIG. 14 shows a press slide speed, a pneumatic die cushion (pad) speed, and a servo die cushion (pad) speed.

The chart in the third-highest stage in FIG. 14 shows an air cylinder thrust in the pneumatic die cushion and a hydraulic cylinder thrust in the servo die cushion.

The chart in the bottom stage in FIG. 14 shows a pneumatic die cushion load and a servo die cushion load.

Normally, one of the pneumatic die cushion device and the servo die cushion device is interlocked with one press machine; however, here, for easy comparison of different properties of both the die cushion devices, physical quantities of die cushions of both die cushion devices when interlocked with the same motion of the same press machine are also shown together.

A die cushion stroke is 300 mm, and a slide speed when the die cushion load starts to be applied (when a slide collides indirectly with the cushion pad via an upper die, a material, a blank holder, and cushion pins) is about 600 mm/s.

Configuration conditions of the pneumatic die cushion device and the servo die cushion device are made identical as long as the principle is not contradicted in order to compare the devices with the scale matched as equal as possible.

The pneumatic die cushion is configured so that its volume communicating with the air cylinder is compressed by 20% when the pneumatic die cushion descends (strokes) by 300 mm (an air tank is equipped with the pneumatic die cushion).

As described in Patent Literature 1 and the like, in a case where the cushion pin pressure equalizing device is applied to the pneumatic die cushion device, the die cushion load that is applied with impact (percussively) when the application of the die cushion load starts is applied directly to the cushion pin pressure equalizing hydraulic cylinder group. Therefore, a surge pressure proportional to the die cushion load is applied also to the hydraulic cylinder group. Repeated application of such a surge pressure (for each cycle) affects badly the piston seals or the like of the hydraulic cylinder group and promotes the deterioration thereof.

Further, there is also a considerable problem of heat generation (increase in temperature of the fluid temperature) in the hydraulic device which generates the initial pressure ($P_{k0}$) in the hydraulic cylinder group for each cycle. As briefly described in Patent Literature 1 and Patent Literature 2, in the conventionally configured hydraulic device, the initial pressure is controlled by releasing (relieving) part of the amount of working fluid that is ejected by rotation of the hydraulic pump to the tank side by opening or closing the closing valve, or the initial pressure is generated through the function of the relief valve in place of the closing valve (an initial pressure generating device employing valve control is used). In a case where the conventional configured hydraulic device is used, the fluid temperature exceeds 40° C. steadily in most cases, and it is not rare that the fluid temperature exceeds 50° C. The life of a standard piston seal of a nitrile rubber correlates with the temperature of a fluid, and using such a piston seal steadily under the high fluid temperature environment promotes the deterioration of the piston seal remarkably.

On the other hand, in the die cushion device with a cushion pin pressure equalizing function according to the first to fourth embodiments of the invention, (in a case where the initial pressure generating device with pump control is used) the initial pressure is generated without releasing (relieving) the amount of working fluid (that is, the working fluid is fully used) that is ejected by rotating the hydraulic pump with the servomotor to the tank via a valve. Thus, the die cushion device according to the first to fourth embodiments has a good energy efficiency, generates little heat to generate the pressure for the die cushion load and the initial pressure for the hydraulic cylinder group, and hence is free from a risk of the fluid temperature exceeding 40° steadily (theoretically and empirically).

Consequently, with the die cushion device with a cushion pin pressure equalizing function according to the invention in which the die cushion load hardly involves a surge, and the fluid temperature of the hydraulic cylinder group is easy to be maintained at 40° or lower steadily, the maintenance of the hydraulic cylinder group can be improved by extending the life of the piston seals or the like in the cushion pin pressure equalizing hydraulic cylinder group.

Here, of the "die cushion device," and the "cushion pin pressure equalizing device" of the die cushion device with a cushion pin pressure equalizing function of the first to fourth embodiments of the invention, the "die cushion device" corresponds to a servo die cushion device disclosed in Japanese Patent Application Laid-Open No. 2006-315074. This servo die cushion device has been proved to have the good performance results in terms of smooth pressure controllability and high mechanical durability. In the comparison example described above, in relation to the form of application of the die cushion load, this servo die cushion device is compared with the general pneumatic die cushion device. However, the comparison may be made with other devices in place of the pneumatic die cushion device in the above example. For example, comparison may be made with a die cushion device which uses a hydraulic cylinder for lifting up and down a cushion pad and has a hydraulic circuit in which a relief valve is provided for pressure control (being different from the servo die cushion device), or with a die cushion device employing a screw mechanism for lifting up and down a cushion pad. Even with these die cushion devices, compared with the servo die cushion device of the present embodiments, a die cushion load tends to involve a surge when the die cushion load starts to be applied due to effects of the valve opening responsiveness of the relief valve in the former die cushion device, and due to the startup friction force of the screw mechanism in the latter die cushion device. Consequently, the die cushion device with a cushion pin pressure equalizing function according to the first to fourth embodiments of the invention has significance in that the servo die cushion device also functions as the cushion pin pressure equalizing device according to the invention.

(3) Patent Literature 1 and Patent Literature 2 do not disclose sufficiently (or lack sufficient disclosure of) the method for generating (controlling) the initial pressure for the cushion pin pressure equalizing hydraulic cylinder group that affects the cushion pin pressure equalization and application, and the die cushion load application (responsiveness and change in responsiveness).

Patent Literature 1 (FIG. 2) and Patent Literature 2 (FIG. 3) do not describe in detail the method for generating the initial pressure for the cushion pin pressure equalizing hydraulic cylinder group. That is, no ground is described for generating the initial pressure accurately (for example, generating the initial pressure with a tolerance of the order of ±1 kg/cm$^2$ with respect to the target initial pressure). The advantageous effects of inventions in Patent Literature 1 and Patent Literature 2 fluctuate by the generation accuracy of the initial pressure, and hence, the description of the ground is important.

For example, in Patent Literature 2, the appropriate initial hydraulic pressure Psso is calculated based on the required piston stroke dimension X and the appropriate blank holder load F that are specific to each die. Patent Literature 2 discloses that in the event that this Psso can be generated (actually accurately), the appropriate press quality intended by the invention described in Patent Literature 2 can be obtained.

However, in relation to the method for generating Psso, Patent Literature 2 only discloses that "the pump 34 and the closing valve 36 are controlled so that the hydraulic pressure Ps that is detected by the hydraulic pressure sensor 38, that is, the initial hydraulic pressure Pss reaches the aforesaid appropriate initial hydraulic pressure Psso." How to control the pump 34 and the closing valve 36 is not disclosed. In addition, the closing valve 36 has to be closed totally in a state where the initial pressure is generated completely, and in that stage, the pump 34 has to be stopped. The controlling method for controlling the two elements is not clear, and there is described no ground for controlling the initial pressure "properly" by the disclosed configuration.

In the embodiments of the present invention, the initial pressure ($P_{kL0}$) of the cushion pin pressure equalizing hydraulic cylinder group based on the lowest die cushion load ($F_L$) is controlled highly accurately (within the range of the order of ±0.1 [kg/cm$^2$] with respect to the initial pressure target value $P_{k0r}$) by the servomotor or the die cushion control servomotor so as to generate the necessary minimum average contraction amount ($\Delta L_k$) to absorb the inclination of the cushion pad and the variation in length of the cushion pins by making use of the elasticity specific to the working fluid without having a special elastic element. As a result of this, the response to application of the die cushion load (the blank holder load) can be stabilized without excessive delay.

<Others>

The invention is not limited to the die cushion devices with a cushion pin pressure equalizing function according to the first to fourth embodiments. The invention also includes the "cushion pin pressure equalizing device" itself which constitutes a part of the die cushion devices with a cushion pin pressure equalizing function. Even in this case, although the servomotor or the like of the "servo die cushion device" cannot be made common as part of the initial pressure generating device, by controlling the initial pressure in the ascending-side pressurizing chambers of the cushion pin pressure equalizing hydraulic cylinder group by the "cushion pin pressure equalizing device" according to the present invention, there is provided an advantageous effect of stabilizing the response to application of the die cushion load (the blank holder load) in the "servo die cushion device" without excessive delay. The "servo die cushion device" in this case includes one in which a screw mechanism is used for lifting up and down a cushion pad, and the screw mechanism is controlled by a servomotor.

While the die cushion hydraulic cylinder and the cushion pin pressure equalizing hydraulic cylinder group employ the working fluid, needless to say, a hydraulic or fluid pressure cylinder employing any type of working fluid such as water, oil or other types of liquid or fluid can be used in this invention.

Further, the invention is not limited to the embodiments that have been described heretofore, and hence, needless to say, the invention can be modified variously without departing from the spirit and scope of the invention.

What is claimed is:

1. A cushion pin pressure equalizing device for a die cushion device including a plurality of cushion pins inserted through a bolster of a press machine, a cushion pad configured to support a blank holder via the plurality of cushion pins, a die cushion load generator configured to generate a die cushion load to be applied to the cushion pad, and a die cushion controller configured to control the die cushion load generator so that the die cushion load generated by the die cushion load generator becomes a set target die cushion load, the cushion pin pressure equalizing device comprising:

a hydraulic cylinder group provided on the cushion pad in which lower ends of the cushion pins that are inserted through the bolster are brought into abutment with piston rods of the hydraulic cylinder group, and ascending-side pressurizing chambers of the hydraulic cylinder group are in communication with each other;

a hydraulic device configured to supply working fluid to the ascending-side pressurizing chambers of the hydraulic cylinder group or to discharge the working fluid from the ascending-side pressurizing chambers;

a pressure detector configured to detect a first pressure of the ascending-side pressurizing chambers of the hydraulic cylinder group;

an initial pressure setting unit configured to set an initial pressure in the ascending-side pressurizing chambers of the hydraulic cylinder group; and an initial pressure controller configured to control the hydraulic device based on the initial pressure set by the initial pressure setting unit and the first pressure detected by the pressure detector, so that the first pressure in the ascending-side pressurizing chambers of the hydraulic cylinder group becomes the initial pressure before the die cushion device starts application of the die cushion load, wherein the initial pressure setting unit sets the initial pressure based on (1) a total volume of the ascending-side pressurizing chambers of the hydraulic cylinder group and a pipe line, (2) a minimum volume change amount of the ascending-side pressurizing chambers of the hydraulic cylinder group when a variation in height of the plurality of cushion pins is absorbed and (3) a volume elastic modulus of the working fluid so that the working fluid has a second pressure corresponding to a lowest die cushion load of the set target die cushion load when the total volume of the working fluid having the initial pressure is compressed by the minimum volume change amount.

2. The cushion pin pressure equalizing device according to claim 1, wherein the initial pressure controller controls the hydraulic device so that the first pressure in the ascending-side pressurizing chambers of the hydraulic cylinder group becomes the initial pressure while the cushion pad is waiting in one operation cycle of the press machine.

3. A die cushion device with a cushion pin pressure equalizing function, comprising:

a plurality of cushion pins inserted through a bolster of a press machine;

a cushion pad configured to support a blank holder via the plurality of cushion pins;

a hydraulic cylinder configured to support the cushion pad and generate a die cushion load to be applied to the cushion pad;

a first hydraulic device configured to supply first working fluid to an ascending-side pressurizing chamber of the hydraulic cylinder or discharge the first working fluid from the ascending-side pressurizing chamber;

a first pressure detector configured to detect a first pressure in the ascending-side pressurizing chamber of the hydraulic cylinder;

a first controller configured to control the first hydraulic device based on the first pressure detected by the first pressure detector so that the die cushion load generated by the hydraulic cylinder becomes a set target die cushion load;

a hydraulic cylinder group provided on the cushion pad in which lower ends of the cushion pins that are inserted through the bolster are brought into abutment with piston rods of the hydraulic cylinder group, and ascending-side pressurizing chambers of the hydraulic cylinder group are in communication with each other;

a second hydraulic device configured to supply second working fluid to the ascending-side pressurizing chambers of the hydraulic cylinder group or discharge the second working fluid from the ascending-side pressurizing chambers;

a second pressure detector configured to detect a second pressure in the ascending-side pressurizing chambers of the hydraulic cylinder group;

an initial pressure setting unit configured to set an initial pressure in the ascending-side pressurizing chambers of the hydraulic cylinder group; and a second controller configured to control the second hydraulic device based on the initial pressure set by the initial pressure setting unit and the second pressure detected by the second pressure detector so that the second pressure in the ascending-side pressurizing chambers of the hydraulic cylinder group becomes the initial pressure before the die cushion load starts to be applied, and wherein the initial pressure setting unit sets the initial pressure based on (1) a total volume of the ascending-side pressurizing chambers of the hydraulic cylinder group and a pipe line, (2) a minimum volume change amount of the ascending-side pressurizing chambers of the hydraulic cylinder group when a variation in height of the plurality of cushion pins is absorbed, and (3) a volume elastic modulus of the second working fluid so that the second working fluid has a third pressure corresponding to a lowest die cushion load of the set target die cushion load when the total volume of the second working fluid having the initial pressure is compressed by the minimum volume change amount.

4. The die cushion device with a cushion pin pressure equalizing function according to claim 3, wherein the first hydraulic device and the second hydraulic device commonly share a first hydraulic pump/motor having a discharge port connected to the ascending-side pressurizing chamber of the hydraulic cylinder and the ascending-side pressurizing chambers of the hydraulic cylinder group via a piping, and a first servomotor connected to a rotational shaft of the first hydraulic pump/motor.

5. The die cushion device with a cushion pin pressure equalizing function according to claim 4, further comprising a valve device configured to connect the discharge port of the first hydraulic pump/motor with the ascending-side pressurizing chamber of the hydraulic cylinder and disconnect the discharge port of the first hydraulic pump/motor from the ascending-side pressurizing chambers of the hydraulic cylinder group, when the first hydraulic device is controlled by the first controller, and configured to disconnect the discharge port of the first hydraulic pump/motor from the ascending-side pressurizing chamber of the hydraulic cylinder and connect the discharge port of the first hydraulic pump/motor with the ascending-side pressurizing chambers of the hydraulic cylinder group, when the second hydraulic device is controlled by the second controller.

6. The die cushion device with a cushion pin pressure equalizing function according to claim 5, wherein the second controller controls the first servomotor so that the second pressure in the ascending-side pressurizing chambers of the hydraulic cylinder group becomes the initial pressure while the cushion pad is waiting in one operation cycle of the press machine.

7. The die cushion device with a cushion pin pressure equalizing function according to claim 6, wherein the first hydraulic device further comprises:

a second hydraulic pump/motor having a discharge port connected to the ascending-side pressurizing chamber of the hydraulic cylinder via a piping; and a second servomotor connected to a rotational shaft of the second hydraulic pump/motor, and wherein the first controller controls only the second servomotor to control a position of the cushion pad while the cushion pad is waiting during a period of time when the first servomotor is controlled by the second controller, and controls both the first servomotor and the second servomotor during at least a pressing process in one operation cycle of the press machine.

8. The die cushion device with a cushion pin pressure equalizing function according to claim 6, wherein the hydraulic cylinder configured to support the cushion pad is provided in plurality, wherein the hydraulic cylinder group is divided into a plurality of hydraulic cylinder groups respectively corresponding to the plurality of the hydraulic cylinders configured to support the cushion pad, and the ascending-side pressurizing chambers of each of the plurality of hydraulic cylinder groups are in communication with each other, wherein the first pressure detector detects respectively pressures in the ascending-side pressurizing chambers of the plurality of the hydraulic cylinders, wherein the second pressure detector detects pressures in the ascending-side pressurizing chambers respectively for the plurality of hydraulic cylinder groups, wherein the initial pressure setting unit can set initial pressures in the ascending-side pressurizing chambers respectively for the plurality of hydraulic cylinder groups, wherein the first hydraulic pump/motor and the first servomotor are provided for each of the plurality of hydraulic cylinders, wherein the first controller controls the plurality of first servomotors based on the pressure detected by the first pressure detector during at least the pressing process in one operation cycle of the press machine so that die cushion loads generated by the plurality of the hydraulic cylinders become target die cushion loads that are set individually, and wherein the second controller individually controls the plurality of first servomotors based on the pressures detected by the second pressure detector while the cushion pad is waiting in one operation cycle of the press machine, except the pressing process and the knockout process so that the pressures in the ascending-side pressurizing chambers of the plurality of hydraulic cylinder groups become the initial pressures that can be set respectively for the plurality of hydraulic cylinder groups.

9. A cushion pin pressure equalizing method for a die cushion device including a plurality of cushion pins inserted through a bolster of a press machine, a cushion pad configured to support a blank holder via the plurality of cushion pins, a die cushion load generator configured to generate a die cushion load to be applied to the cushion pad, and a die cushion controller configured to control the die cushion load generator so that the die cushion load generated by the die cushion load generator becomes a set target die cushion load, the cushion pin pressure equalizing method comprising:

preparing a hydraulic cylinder group provided on the cushion pad in which lower ends of the cushion pins that are inserted through the bolster are brought into abutment with piston rods of the hydraulic cylinder group, and ascending-side pressurizing chambers of the hydraulic cylinder group are in communication with each other;

setting an initial pressure for the ascending-side pressurizing chambers of the hydraulic cylinder group; and controlling a first pressure of a working fluid sealed in the ascending-side pressurizing chambers of the hydraulic cylinder group so that the first pressure in the ascending-side pressurizing chambers of the hydraulic cylinder group becomes the set initial pressure while the cushion pad is waiting in one operation cycle of the press machine, wherein, in the setting of the initial pressure, the initial pressure is set based on (1) a total volume of the ascending-side pressurizing chambers of the hydraulic cylinder group and a pipe line, (2) a minimum volume change amount of the ascending-side pressurizing chambers of the hydraulic cylinder group when a variation in height of the plurality of cushion pins is absorbed, and (3) a volume elastic modulus of the working fluid so that the working fluid has a second pressure corresponding to a lowest die cushion load of the set target die cushion load when the total volume of the working fluid having the initial pressure is compressed by the volume change amount.

10. The cushion pin pressure equalizing method according to claim 9, wherein the die cushion load generator includes:

a hydraulic cylinder configured to generate a die cushion load to be applied to the cushion pad; and a hydraulic device configured to supply the working fluid to an ascending-side pressurizing chamber of the hydraulic cylinder or to discharge the working fluid from the ascending-side pressurizing chamber, and wherein, in the setting of an initial pressure, the pressure in the ascending-side pressurizing chambers of the hydraulic cylinder group is controlled so as to become the initial pressure by using the hydraulic device during a time period in which the cushion pad is kept in a standby position.

* * * * *